US012576436B2

(12) United States Patent
Fedor et al.

(10) Patent No.: US 12,576,436 B2
(45) Date of Patent: Mar. 17, 2026

(54) METHOD AND APPARATUS FOR VERTICAL ROLL STORAGE

(71) Applicant: Morgan Engineering Systems, Inc., Alliance, OH (US)

(72) Inventors: Mark Len Fedor, Hartville, OH (US); Steve D. Herron, Salem, OH (US); Kenneth Dean Maurer, Canton, OH (US); Jay Allen May, Canton, OH (US); Michael B. Fagan, II, Alliance, OH (US); Scott A Zilke, Berlin Center, OH (US); Keith Allen Mathews, V, OH (US)

(73) Assignee: Morgan Engineering Systems, Inc., Alliance, OH (US)

( * ) Notice: Subject to any disclaimer, the term of this patent is extended or adjusted under 35 U.S.C. 154(b) by 319 days.

(21) Appl. No.: 18/185,192

(22) Filed: Mar. 16, 2023

(65) Prior Publication Data

US 2024/0307935 A1 Sep. 19, 2024

(51) Int. Cl.

| | |
|---|---|
| ***B21B 31/02*** | (2006.01) |
| ***B21B 31/12*** | (2006.01) |
| ***B21B 37/00*** | (2006.01) |

(52) U.S. Cl.

CPC ..... *B21B 31/02* (2013.01); *B21B 31/12* (2013.01); *B21B 37/00* (2013.01)

(58) Field of Classification Search

CPC ..... B66C 13/46; B66C 11/00; B66C 11/04; B66C 11/06; B66C 19/00; B66C 7/02; B66C 9/02; H01L 21/67259; H01L 21/67733; H01L 21/67724; H01L 21/67769; H01L 21/67265; H01L 21/681; H01L 2203/044; H01L 21/67775; B65G 1/0457; B65G 1/04; B65G 1/00;

(Continued)

(56) References Cited

U.S. PATENT DOCUMENTS

| | | | | |
|---|---|---|---|---|
| 2,989,304 | A * | 6/1961 | Ulmann | E05D 13/06 60/903 |
| 3,425,256 | A * | 2/1969 | Mcgoogan | B21B 31/08 72/239 |
| 3,934,447 | A * | 1/1976 | Brodeur | B21B 31/12 294/81.1 |
| 4,726,108 | A * | 2/1988 | Poloni | B21B 31/08 72/239 |

(Continued)

FOREIGN PATENT DOCUMENTS

| | | | | |
|---|---|---|---|---|
| DE | 10136398 | A1 * | 3/2003 | B66C 13/46 |
| EP | 1043262 | A1 * | 10/2000 | B66C 13/46 |

(Continued)

*Primary Examiner* — Anna M Momper
*Assistant Examiner* — Hendrix Soto
(74) *Attorney, Agent, or Firm* — Sand, Sebolt & Wernow Co., LPA

(57) ABSTRACT

An assembly, system and method for compensating a crane position offset error based on wheel float by viewing, with an optical sensor located on a trolley on the crane, a target or target shape adjacent a storage rack containing a vertically stored mill roll and determining a positional compensation signal based on a separation or offset of a center of a field of view of the sensor from a center of the target shape. The assembly, system or method compensates for the crane position offset error by moving the crane, as instructed by the positional compensation signal, a distance equal to the separation or offset of the center of the field of view of the sensor from the center of the target.

18 Claims, 20 Drawing Sheets

(58) Field of Classification Search
CPC ..... B65G 35/00; B65H 19/12; B21B 13/06; B21B 31/00; B21B 31/02; B21B 31/08; B21B 31/12; B21B 2203/34
See application file for complete search history.

(56) References Cited

U.S. PATENT DOCUMENTS

| | | | | |
|---|---|---|---|---|
| 2003/0110649 | A1* | 6/2003 | Hudgens | H01L 21/67259 33/286 |
| 2012/0175334 | A1* | 7/2012 | Chen | B66C 19/00 212/71 |
| 2016/0167932 | A1* | 6/2016 | Holmberg | B66C 19/002 382/104 |
| 2020/0118853 | A1* | 4/2020 | Harasaki | G06T 7/0004 |
| 2020/0223640 | A1* | 7/2020 | Shin | B61B 3/02 |

FOREIGN PATENT DOCUMENTS

| | | | | | |
|---|---|---|---|---|---|
| EP | 3000762 | A1 | * | 3/2016 | B66C 13/085 |
| JP | S57146411 | A | * | 9/1982 | |
| JP | S6096313 | A | * | 5/1985 | |
| JP | H03248705 | A | * | 11/1991 | |
| JP | H055206 | U | * | 1/1999 | |
| JP | 2989304 | B2 | * | 12/1999 | B21B 39/16 |
| JP | 2001300610 | A | * | 10/2001 | |
| JP | 2003020191 | A | * | 1/2003 | |
| JP | 4365246 | B2 | * | 11/2009 | B66C 13/085 |
| JP | 5039385 | B2 | * | 10/2012 | B66C 13/085 |
| KR | 20000047599 | A | * | 7/2000 | |

* cited by examiner

METHOD AND APPARATUS FOR VERTICAL ROLL STORAGE

TECHNICAL FIELD

This disclosure is directed to the storage of mill rolls in a vertical orientation.

BACKGROUND ART

Mill rolls are used in the steel manufacturing process. Mill rolls are typically used to roll steel. They are a costly part of the steel manufacturing process inasmuch as mill rolls are a consumable item that need replaced. Mill rolls come in different shapes and sizes because each different mill roll is used for a specific purpose in the production of steel. Their performance depends on many factors including the materials used and the loads to which they are subjected to during service. Because steel production facilities often manufacture many different types and shapes of steel, these facilities often have many different types of mill rolls in their inventory. Due to the high number of mill rolls that must be kept in inventory, mill rolls must be stored when they are not in use.

Storing mill rolls in a horizontal arrangement is a common practice in many industries, such as at a steel production facility, and it requires careful planning and execution to ensure that the rolls are protected and can be easily moved when needed. For the storage of mill rolls Horizontally or in a horizontal arrangement, the facility often selects a suitable location where the storage area should be clean, dry, and well-ventilated. It should also be spacious enough to accommodate the size and weight of the mill rolls. The mill rolls may be stored on horizontal racks. The racks are sturdy racks or cradles that are specifically designed to support mill rolls. The racks should be level and stable to prevent the rolls from shifting or falling. Before storing the rolls, a facility operator will often inspect them for any damage or defects. If any issues are found, they can be repaired or corrected before storage. To position the mill rolls, they are placed horizontally on the storage racks. Typically, it is ensured that there is enough space between the rolls to prevent them from touching each other. Sometimes, the mill rolls are secured through the use straps, chains, or other suitable restraints to secure the mill rolls to the racks. This will prevent them from moving or falling during storage.

With respect to moving mill rolls to another location, the facility operator will plan the move. Before moving the mill rolls, the facility operator should plan the route and ensure that it is clear of obstacles, and identify the equipment and personnel needed to perform the move safely. The movement of the mill rolls requires lifting equipment. The lifting equipment often includes the use a crane, forklift, or other suitable lifting equipment to lift the mill rolls off the storage racks. The lifting equipment should be capable of handling the weight and size of the rolls. The facility operate will attach the lifting equipment to the mill rolls using slings, hooks, or other suitable lifting attachments to secure the mill rolls to the lifting equipment. The facility operator will use or instruct the lifting equipment to lift the mill rolls by carefully lifting the mill rolls off the storage racks, making sure that they are stable and balanced. Then, the mill rolls are transported by moving the mill rolls to their new location using the designated route. During movement or transport, it should be ensured that the rolls are properly secured and that they do not come into contact with any obstacles.

Although storing mill rolls is the horizontal position has been used for many years, it is not without its drawbacks. Mainly, storing mill rolls in a horizontal position takes up a large amount of space.

One solution to the problem associated with the amount of space occupied by mill rolls that are stored in the horizontal position is to change the orientation in which the mill rolls are stored. Particularly, one solution provides for storing the mill rolls in a vertical position. Storing mill rolls in a vertical position allows the "footprint" or storage area of each mill roll to be lessened.

However, when a mill roll is stored in a vertical position, it must be picked up by one of its trunnions. To pick up the roll by the trunnion, the crane must have a grasping or grabbing and lifting assembly/device that is centered over the elevated trunnion. Centering the grabbing and lifting assembly of the trunnion may be difficult due to the amount of wheel float that is present on the trolley or crane.

SUMMARY OF THE INVENTION

Although manners compensating for a known amount wheel float are known, the manner of determining the amount of wheel float during the operation of the crane is difficult. For example, the crane will not know how to compensate for the wheel float until it is determined. Thus, a need continues to exist for a better system, assembly and method for determining wheel float, especially for vertically stored mill rolls, so that the determined amount of wheel float may be corrected or compensated to properly position the grasping and lifting device so that it may lift one of the vertically stored mill rolls or other item.

The present disclosure provides a solution for determining and thereby compensating for wheel float in trolleys or cranes that are designed to lift an item, such as a mill roll stored in a vertical position. Although the examples detailed herein are directed to vertically stored mill rolls, the technology and techniques detailed herein can apply to any device that a crane needs to lift regardless of its shape, configuration or stored orientation.

In one aspect, an exemplary embodiment of the present disclosure may provide a mill roll storage assembly comprising: a mill roll stand adapted to support one or more mill rolls in a vertical position; a target shape coupled to or defined by a portion of the mill roll stand, wherein the target shape is in operative communication with a sensor on a crane located above the mill roll storage assembly, wherein the sensor is adapted to locate a center of the target. This exemplary embodiment or another exemplary embodiment may further provide an opening defined by the mill roll stand, wherein the opening is adapted receive one of the mill rolls in the vertical position; a diagonal axis extending diagonally across the opening; and wherein the diagonal axis extends through a center of the shape on the target shape. This exemplary embodiment or another exemplary embodiment may further provide a target plate, wherein the target plate defines the target shape; and an interior edge on the target plate, wherein the interior edge defines the target shape and is formed as aperture in the target plate, the interior edge having an outline of a shape, wherein the sensor is programmed to detect the shape. This exemplary embodiment or another exemplary embodiment may further provide a target plate, wherein the target plate defines the target shape and the target plate is permanently affixed to a surface of the mill roll stand. This exemplary embodiment or another exemplary embodiment may further provide an edge on the target plate defining a truncated corner of the target plate, wherein the edge is aligned parallel to a longitudinal direction of the mill roll stand. This exemplary embodiment or another exemplary embodiment may further provide a target position fixture removably coupled to the mill roll stand. This exemplary embodiment or another exemplary embodiment may further provide a first direction associated with the target position fixture and a second direction associated with the target position fixture, wherein the first direction is perpendicular to the second direction; a diagonal axis extending diagonally across the target position fixture relative to the first direction and the second direction; and an extension on the target position that includes at least one surface that is parallel to the diagonal axis, and the target shape is centered in the extension. This exemplary embodiment or another exemplary embodiment may further provide a rectangular frame defining an opening, wherein the opening receives a portion of one mill roll therethrough; a first corner of the rectangular frame, wherein a diagonal axis extends through the first corner from a center of the central opening; and a first arm extending outwardly or in a cantilevered manner from adjacent the first corner of the rectangular frame, wherein the first arm is parallel to the diagonal axis.

In yet another aspect, an exemplary embodiment of the present disclosure may provide a system for storing and lifting vertically oriented mill rolls, the system comprising: a crane including at least one rail; a trolley on the crane that moves relative to the at least one rail via at least one wheel; a sensor that moves in unison with the trolley; a mill roll stand that is positioned below the trolley and the mill roll stand is adapted to support one or more mill rolls in a vertical position; a target shape coupled to mill roll stand, wherein the target shape is in operative communication with the sensor, wherein the sensor is adapted to locate a center of the target shape; and a controller having wheel float logic that is in operative communication with the sensor, wherein the controller is configured to determine an offset distance between a portion of the sensor with the center of the target shape and generate a signal that instructs the wheel to move to thereby align the portion of the sensor with the center of the target shape. This exemplary embodiment or another exemplary embodiment may further provide a grasping and lifting device on the crane; a trunnion defining an elevated end of one mill roll; wherein alignment of the portion of the sensor with the center of the target shape results in the alignment of the grasping and lifting device with the elevated end of one mill roll. This exemplary embodiment or another exemplary embodiment may further provide that the sensor is an optical sensor having a field of view (FOV) that is directed downward from the trolley toward the mill roll stand. This exemplary embodiment or another exemplary embodiment may further provide a center of the FOV for the optical sensor; wherein the portion of the sensor that is determined to be offset from the center of the target is the center of the FOV. This exemplary embodiment or another exemplary embodiment may further provide that the controller is configured to generate the signal to instruct the wheel to move to thereby align the center of the FOV with the center of the target.

In yet another aspect, an exemplary embodiment of the present disclosure may provide a method comprising: providing a rack or stand containing at least one mill roll stored in a vertical position, and a target shape positioned adjacent the at least one mill roll; moving a crane carrying a sensor above the at least one mill roll; determining a center of the at least one roll via the sensor sensing a position of the crane relative to the target shape; and lifting the at least one roll by grasping an elevated end of the at least one roll from via the crane. This exemplary embodiment or another exemplary embodiment may further provide that the sensor is an optical sensor, further comprising: viewing, with the optical sensor, the target shape; and determining a center of the target shape. This exemplary embodiment or another exemplary embodiment may further provide determining an offset of a center of a field of view (FOV) of the optical sensor from the center of the target shape. This exemplary embodiment or another exemplary embodiment may further provide moving the crane a distance equal to the offset to align a grasping and lifting device of the crane with a center of the elevated end of the at least one roll. This exemplary embodiment or another exemplary embodiment may further provide sending a signal to a motor on the crane to move the crane in at least one of two directions to align the grasping and lifting device with the center of the elevated end of the at least one roll; and lowering the grasping device in a third direction toward the elevated end of the vertical roll.

In another aspect, and exemplary embodiment of the present disclosure may provide an assembly, system and method for eliminating or compensating for a crane position offset error based on wheel float by viewing, with an optical sensor located on a trolley on the crane, a target or target shape adjacent a storage rack containing a vertically stored mill roll and determining a positional compensation signal based on a separation or offset of a center of a field of view of the sensor from a center of the target shape. The assembly, system or method eliminates or compensates for the crane position offset error by moving the crane, as instructed by the positional compensation signal, a distance equal to the separation or offset of the center of the field of view of the sensor from the center of the target.

BRIEF DESCRIPTION OF THE DRAWINGS

One or more exemplary embodiment(s) of the present disclosure is set forth in the following description, is shown in the drawings and is particularly and distinctly pointed out and set forth in the appended claims. The accompanying drawings, which are incorporated in and constitute a part of the specification, illustrate various example configurations and methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
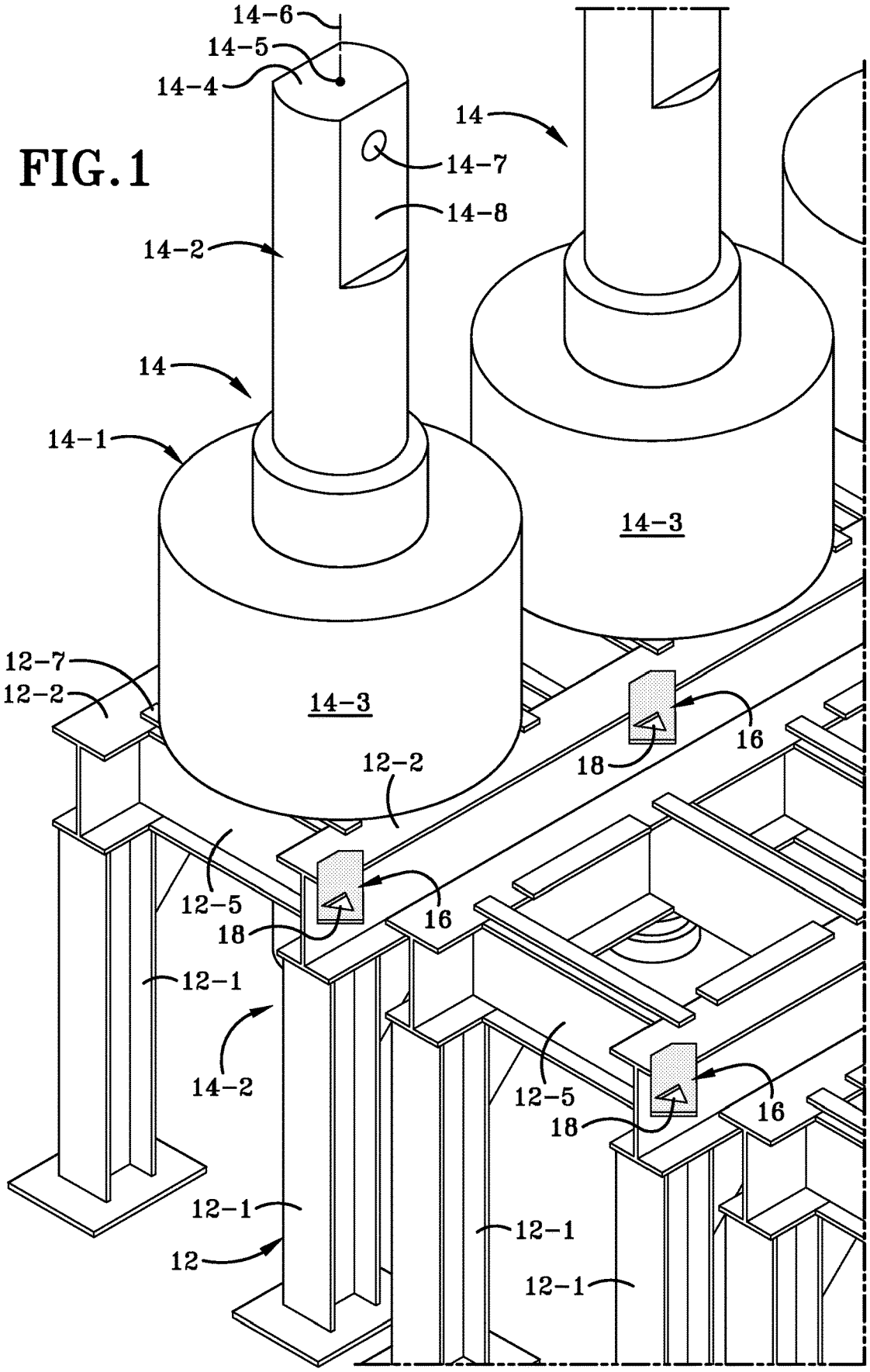
FIG. 1 is a perspective view of an exemplary mill roll stand or rack that stores a mill roll in a vertical orientation.

Mill rolls are utilized for forming shapes in steel or other metals. Typically, these mill rolls are stored horizontally. However, the mill rolls may be also stored vertically. When the mill rolls are stored vertically, the trunnions or pins at the end of the rolls are vertically aligned such that the central axis of the roll is aligned directly vertical. This results in one of the ends of the roll being considered as an elevated end. One advantage of storing mill rolls vertically is to alleviate space constraints within a factory or production facility. In order to ultimately utilize these mill rolls in the steel production process, the mill rolls must be grasped by a grasping device capable of lifting the rolls and moving them to another location within the factory. However, centering the grasping and lifting device over the elevated trunnion can be difficult due to wheel float in the trolley or crane.

For facilities that store their mills rolls in a vertical position, the trunnion on each mill roll can have a bore drilled there through, wherein the bore is perpendicular to the primary rolling axis of the mill roll. The bore in the trunnion is configured to receive a pin or arbor on the grasping and lifting device which is in operative communication with the crane. When the pin or arbor on the grasping and lifting device is inserted through the bore on the trunnion, the crane may lift the mill roll from out of its vertical storage rack and move it to a different location while remaining in the vertical position. In order to accomplish the lifting of the vertical roll by the grasping and lifting device, the crane will move over the elevated end or defined by one of the trunnions on the mill roll stored in the vertical position. The crane will lower until the grasping and lifting device finds the top or end of the trunnion. Once the grasping and lifting device reaches the top end of the elevated trunnion, it will spin around a vertical axis to locate the bore drilled through the trunnion. The distance of the bore located below the elevated end of the trunnion is a preset distance known to the processing components contained on the crane. Once the hole is located, a pin on the grasping and lifting assembly may be inserted through the bore and locked into position. With the pin inserted through the bore in the trunnion, the crane may hoist the mill roll and lift it up to remove it from its storage rack and then move it to another location.

According to one aspect of the present disclosure, the assembly and method detailed herein assists with determining, correcting and/or eliminating the problem previously associated with wheel float when needing to pick up the mill rolls that are stored in a vertical position. On the crane, there is a bridge that carries a trolley. Particularly, the wheels on the crane ride along rails. The wheels have a flange that space the wheels a short distance from an edge of the rail. Thus, the float is the distance for which the crane may be slightly off-center relative to the rails. In some cranes, the amount of wheel float in one direction may be upwards of one inch.

In one exemplary embodiment of the present disclosure, on the trolley there is a sensor that is pointed downwardly towards the rack and stored vertical mill rolls. In one embodiment, the sensor is an optical sensor such as a camera that may operate in any spectrum as one having skill in the art would understand. However, other non-optical sensors are entirely possible. When the sensor is an optical sensor, the sensor has a field of view that is directed downward from the overhead crane or trolley towards the rack or mill roll stand.

In one particular embodiment of the present disclosure, within the field of view is a target plate that defines a shape or the shape of a symbol that the sensor is programmed to locate. When the camera views the shape defined by the target plate, positioning logic determines which direction the crane is offset due to wheel float. Then, based on the offset distance of the center of the field of view relative to (or from) the center of the shape on the target plate, logic or a signal generator generates one or more signals that when executed by a processor directs or instructs the motors on the crane or trolley to move the wheels to compensate for and reduce or eliminate the wheel float. Moving the crane causes the center of the field of view to move and align with the center of the shape or symbol on the target. This movement results in aligning the center of the elevated end of the mill roll, defined by one of the trunnions, with the center of the grasping and lifting device. The centering of the field of view relative to the target symbol causes the grasping device to be centered over the elevated end of the mill roll because there is a defined distance from the central vertical axis of the mill roll relative to the location of the center of the shape of the target. Stated otherwise, the grasping and lifting device moves in unison with the sensor when the sensor is trying to be aligned with the center of the shape on the target plate. Thus, when the trolley moves the optical sensor moves, the grasping and lifting device is also moved and thereby centered over the vertical axis of the elevated end of the mill roll that is defined by one of the trunnions.

FIG. 1 depicts a mill roll storage system 10 that includes a rack or stand 12 that is configured to hold one or more mill rolls 14 in a vertical orientation or configuration. System 10 further includes a target plate 16 defining a shape or symbol 18. As will be described in greater detail herein, the target plate and defined shape 18 assists with the centering of a lifting and grasping and device on a crane to lift and lower the mill rolls 14 onto the stand 12 by allowing a sensor to locate the center of the shape 18 which thereby locates the center of a vertical primary axis associated with each mill roll to thereby eliminate wheel floats in the crane.

Figure 2:
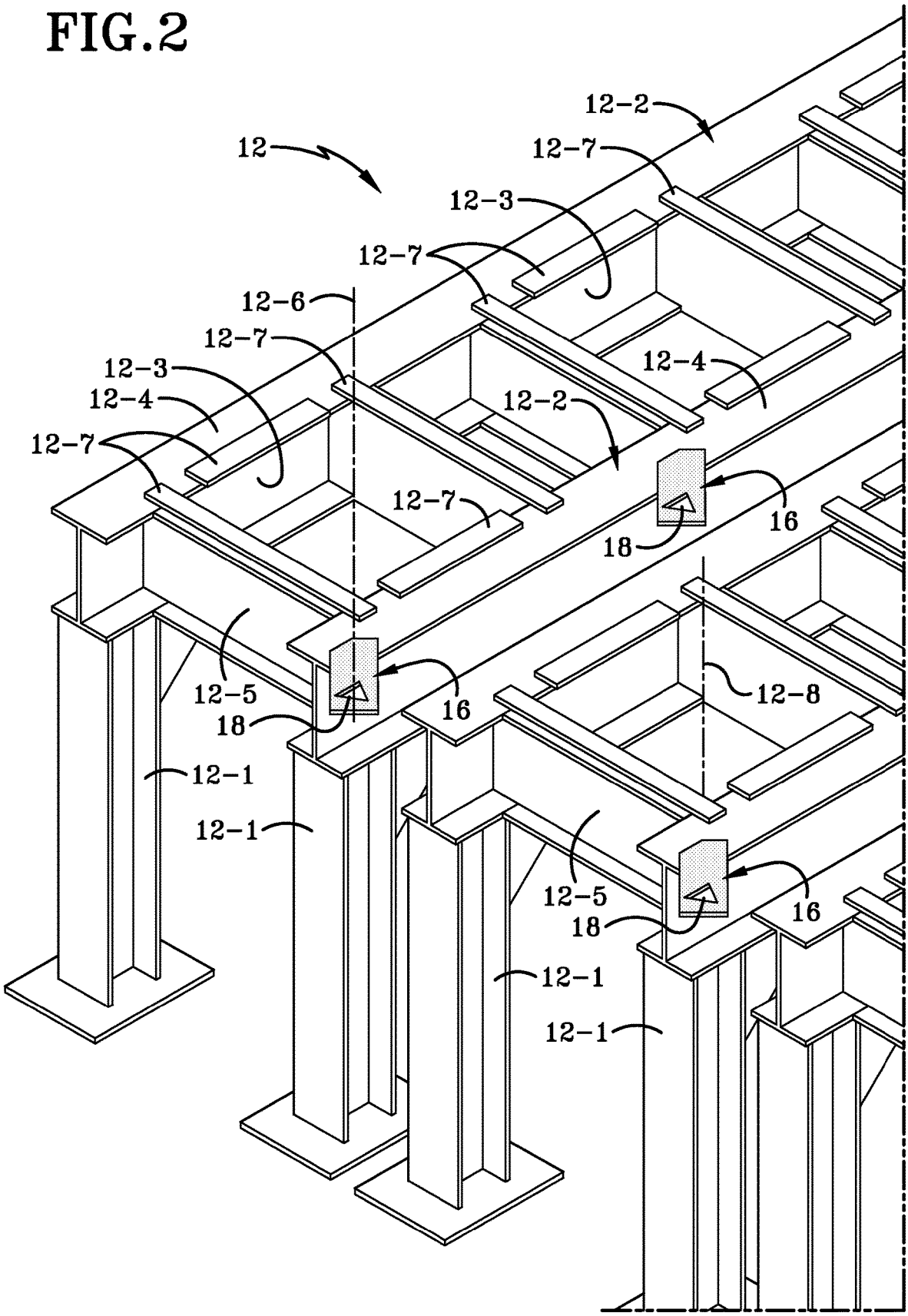
FIG. 2 is a perspective view of exemplary mill roll stand or rack.

FIG. 2 depicts that the stand 12 includes a plurality of vertical supports 12-1 that elevate longitudinal supports 12-2 above the ground surface. Longitudinal supports 12-2 may extend from a first end to a second end and be disposed within manufacturing facility. Longitudinal supports 12-2 maybe spaced apart rails or beams. In one particular embodiment the longitudinal supports 12-2 are formed from I-beams defining an upper surface 12-4. The target plate 16 is rigidly connected or coupled to the upper surface 12-4 of one of the longitudinal supports 12-2.

With continued reference to FIG. 2, there may be a plurality of transverse supports 12-5 that extend between a pair of longitudinal supports 12-2 and are orthogonal thereto. Between a pair of longitudinal supports 12-2 and a pair of transverse supports 12-5 is defined an opening 12-3 that is configured to receive one mill roll 14 in a vertical configuration. In one particular embodiment, the opening 12-3 is a square opening defined by the longitudinal supports 12-2 that extend in a first direction and the transverse supports 12-5 that extend in a second direction that is orthogonal to the first direction. The opening 12-3 has a diagonal axis 12-6 that extends from one corner of the opening 12-3 to an opposing corner of the opening 12-3, wherein the diagonal axis 12-6 extends directly through the center 12-8 of opening 12-3. As will be described in greater detail herein the length of the target plates 16 and the center of the shape 18 lie along the diagonal axis 12-6.

The stand 12 may further include shims 12-7 that surround each side of the opening 12-3 and are positioned on top of the upper surface 12-4 of the longitudinal supports 12-1 and atop the upper surface of the transverse supports 12-5. The shims 12-7 are configured to contact a sidewall 14-1 of one roll 14 when it is stored in a vertical position. In other embodiments, the shims 12-7 may be optional such that roll 14 rest directly on the upper surface 12-4 of supports 12-2 and/or 12-5.

With continued reference to FIG. 1 and FIG. 2, the roll 14 includes two trunnions 14-2 that are on either side of the convex surface 14-3 that is located between sidewalls 14-1 of roll 14. When the roll 14 is stored in the vertical position, as shown in FIG. 1, one of the trunnions 14-2 is elevated to define an elevated end of the roll 14. The elevated end of the roll 14 defined by trunnion 14-2 may have a flat surface 14-4. Notably, flat surface 14-4 may be an upper flat surface when the roll 14 is stored vertically, but the flat surface would be an end or side of the roll 14 when the roll is in actual usage and removed from stand 12 inasmuch as the rolls 14 are horizontally aligned when rolling steel or other metal. There is a center 14-5 of the flat surface 14-4 through which the primary rotational axis of the roll 14 extends. The primary rotational axis or simply axis 14-6 is directly vertical when the roll 14 is stored within the opening 12-3 on stand 12. The trunnion 14-2 further includes or defines a bore 14-7 that extends transversely through a flat sidewall 14-8 on trunnion 14-2. The bore 14-7 is orthogonal to axis 14-6.

Figure 3:
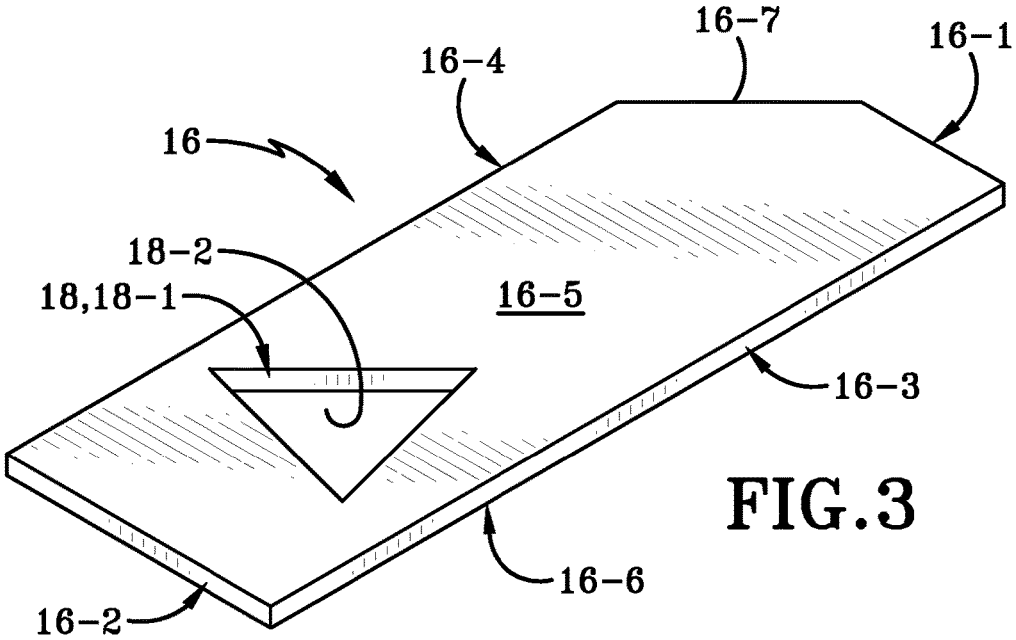
FIG. 3 is a perspective view of an exemplary target plate that defines a shape or symbol.

FIG. 3 is an isometric perspective view of the target plate 16. Target plate 16 includes a first end 16-1 opposite a second end 16-2, and a first side 16-3 opposite a second side 16-4. Target plate 16 includes a top surface 16-5 opposite a bottom surface 16-6, wherein a thickness of the target plate is defined by the dimension between the top surface 16-5 and the bottom surface 16-6. In one particular embodiment, the thickness of the target plate 16 is a minimum dimension of the target plate 16 relative to the length of the plate measured between first end 16-1 and the second end 16-2, and relative to the width of the plate measured between the first side 16-3 and the second side 16-4.

Target plate 16 is a generally rectangular plate except for a truncated corner defined by the truncated edge 16-7. The edge 16-7 extends from an edge defining the first end 16-1 to the edge defining the second side 16-4. As such, the perimeter of the plate is substantially rectangular except for the edge 16-7 that truncates what would be one corner of a rectangular plate. The angle defined between the edge 16-7 and the edges defining the first end 16-1 and the second side 16-4 should be approximately 135 degrees which will orient the center of the target plate 16 with the diagonal axis 12-6 of associated with the opening 12-3 as indicated in FIG. 3A.

Target plate 16 defines the symbol or shape 18 within the plate 16. In one particular embodiment, shape 18 defined by an edge 18-1 that is entirely bounded between the first end 16-1 and the second end 16-2 and the first side 16-3 and the second side 16-4 of target plate 16. The edge 18-1 defines an opening or aperture 18-2 that extends vertically through the thickness of the target plate 16 from the top surface 16-5 to the bottom surface 16-6. Collectively, the edge 18-1 defines the shape 18. The shape 18 defined in the plate 16 may be any geometric configuration so long as the shape 18 that is defined by an edge 18-1 has a center 18-3. As such, it may be beneficial to utilize symmetric shapes defined by edge 18-1 that extend entirely through the plate 16 so that the center 18-3 can be located by a sensor 22-4 on the crane 22 in order to properly lift the roll 14 from its position on rack 12 or stand 12 as will be described in greater detail herein. Although a symmetrical shape 18 is preferable, any shape defined by edge 18-1 is possible. Stated otherwise, unless explicitly stated that a particular shape or configuration of a component is mandatory, any of the elements, components, or structures discussed herein may take the form of any shape. Thus, although the figures depict the various elements, components or structures of the present disclosure according to one or more exemplary embodiments, it is to be understood that any other geometric configuration of that element, component or structure is entirely possible. For example, instead of the shape or symbol 18 being the shown configurations in FIG. 3, the shape or symbol 18 can be semi-circular, triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration.

Figure 3A:
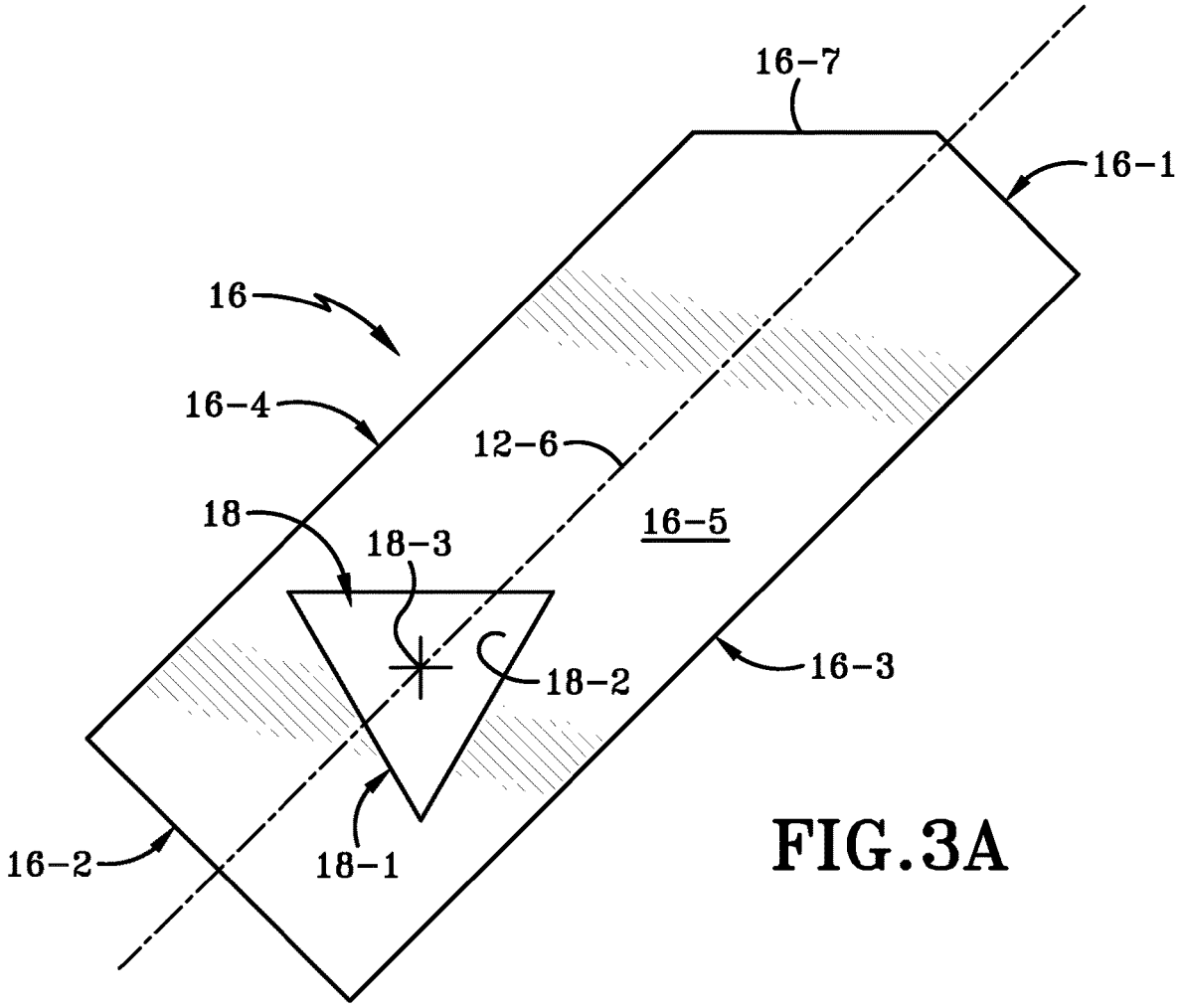
FIG. 3A is a top plan view of the exemplary target plate with the shape or symbol formed as a triangle.
Figure 3B:
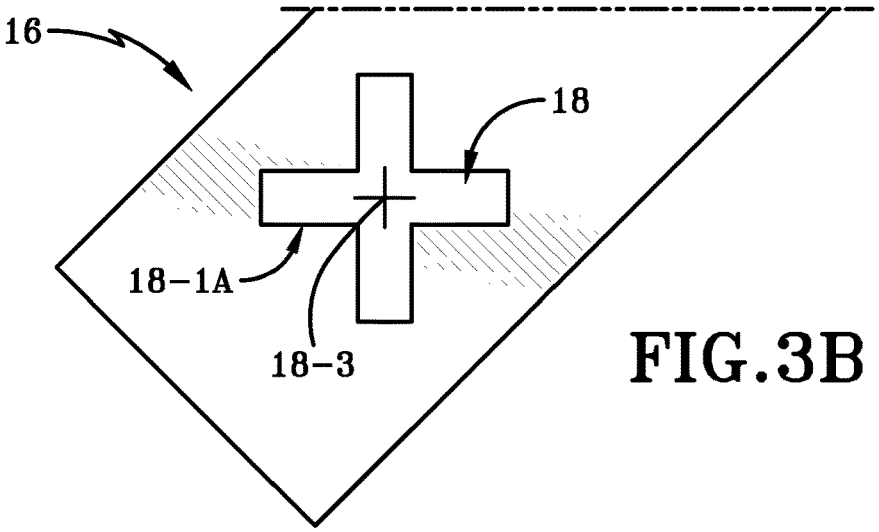
FIG. 3B is a top plan view of another exemplary target plate with the shape or symbol formed as an X or plus sign.
Figure 3C:
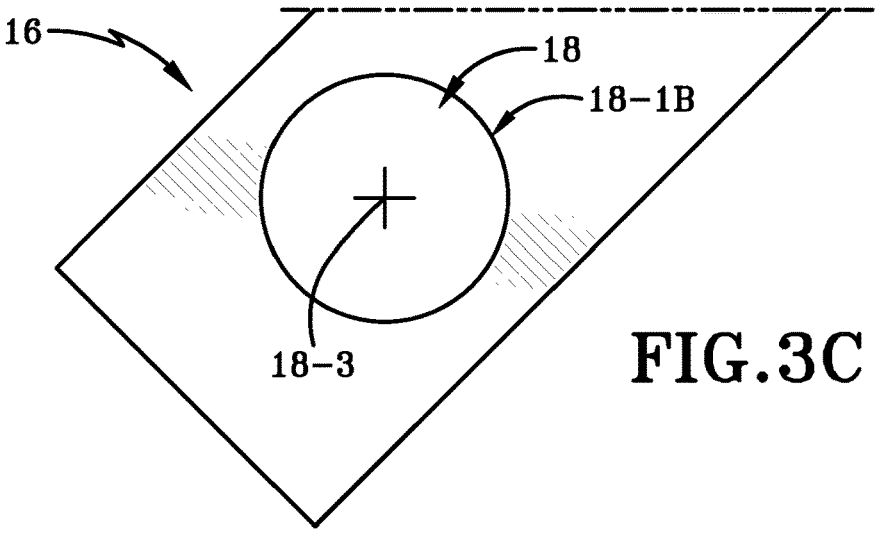
FIG. 3C is a top plan view of another exemplary target plate with the shape or symbol formed as a circle.
Figure 3D:
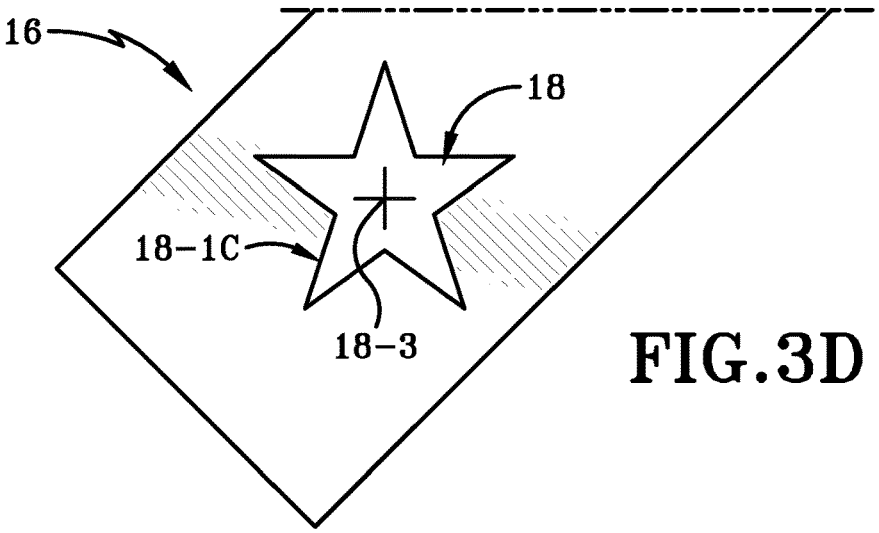
FIG. 3D is a top plan view of another exemplary target plate with the shape or symbol formed as star.

For example, FIG. 3A depicts an edge 18-1 defining an opening 18-2 that is in the shape 18 of a triangle. The triangle shape 18 has a center 18-3 that is coaxial or centered along the diagonal axis 12-6 associated with the opening 12-3. Yet, the shape or symbol 18 may take on other configurations as indicated in FIG. 3B, FIG. 3C, and FIG. 3D. FIG. 3B depicts the shape 18 being defined by an edge 18-1A that is shaped as an X or a plus (+) symbol, having a center 18-3. FIG. 3C depicts an edge 18-1B defining a circular shape 18 having a center 18-3. FIG. 3D depicts a star-shaped edge 18-1C defining a star shape 18 having a center 18-3. The embodiments shown in FIG. 3A-FIG. 3D are merely examples and it needs to be understood that the shape 18 defined within the target plate 16 may take on any configuration. Further, although the target shape 18 would be coupled to stand 12 via plate 16, it is entirely possible for the shape 18 could be defined by a portion of the mill roll stand 12, such as being formed directly in surface 22-4.

Figure 4A:
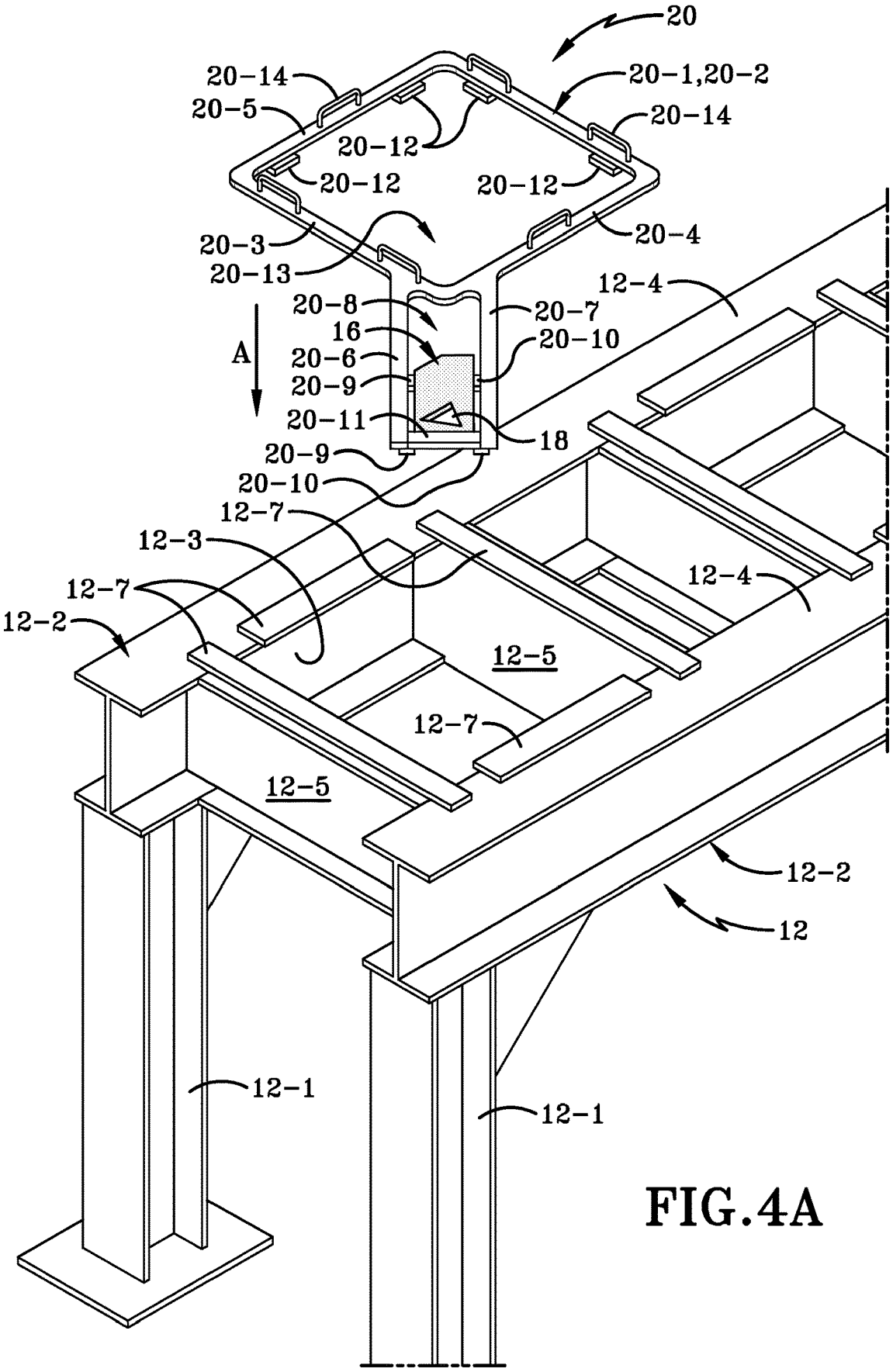
FIG. 4A is an operational perspective view of a target position fixture adjacent the stand or rack for installing the target plate.
Figure 4B:
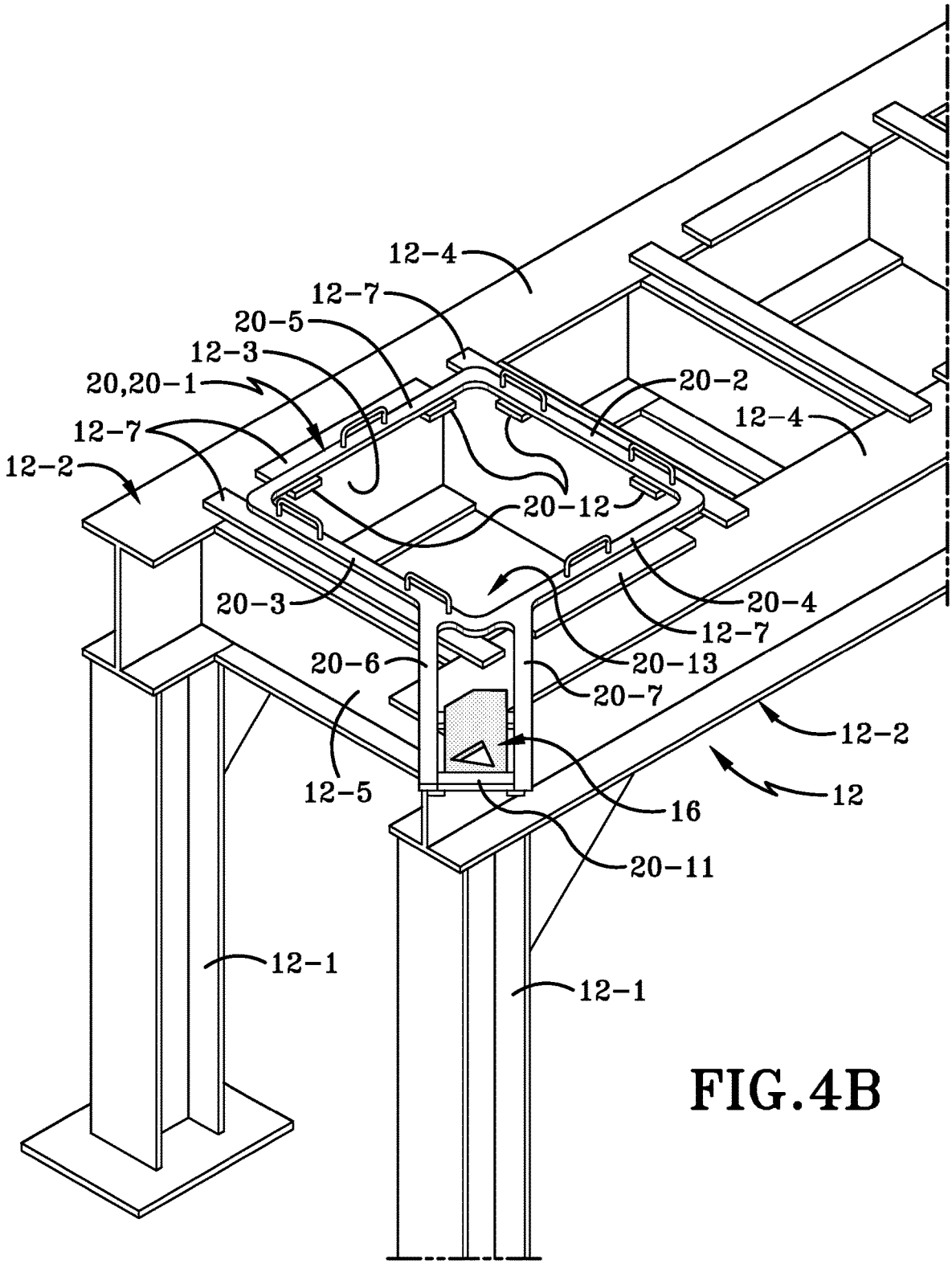
FIG. 4B is an operational perspective view of the target position fixture on the stand or rack for installing the target plate.
Figure 4C:
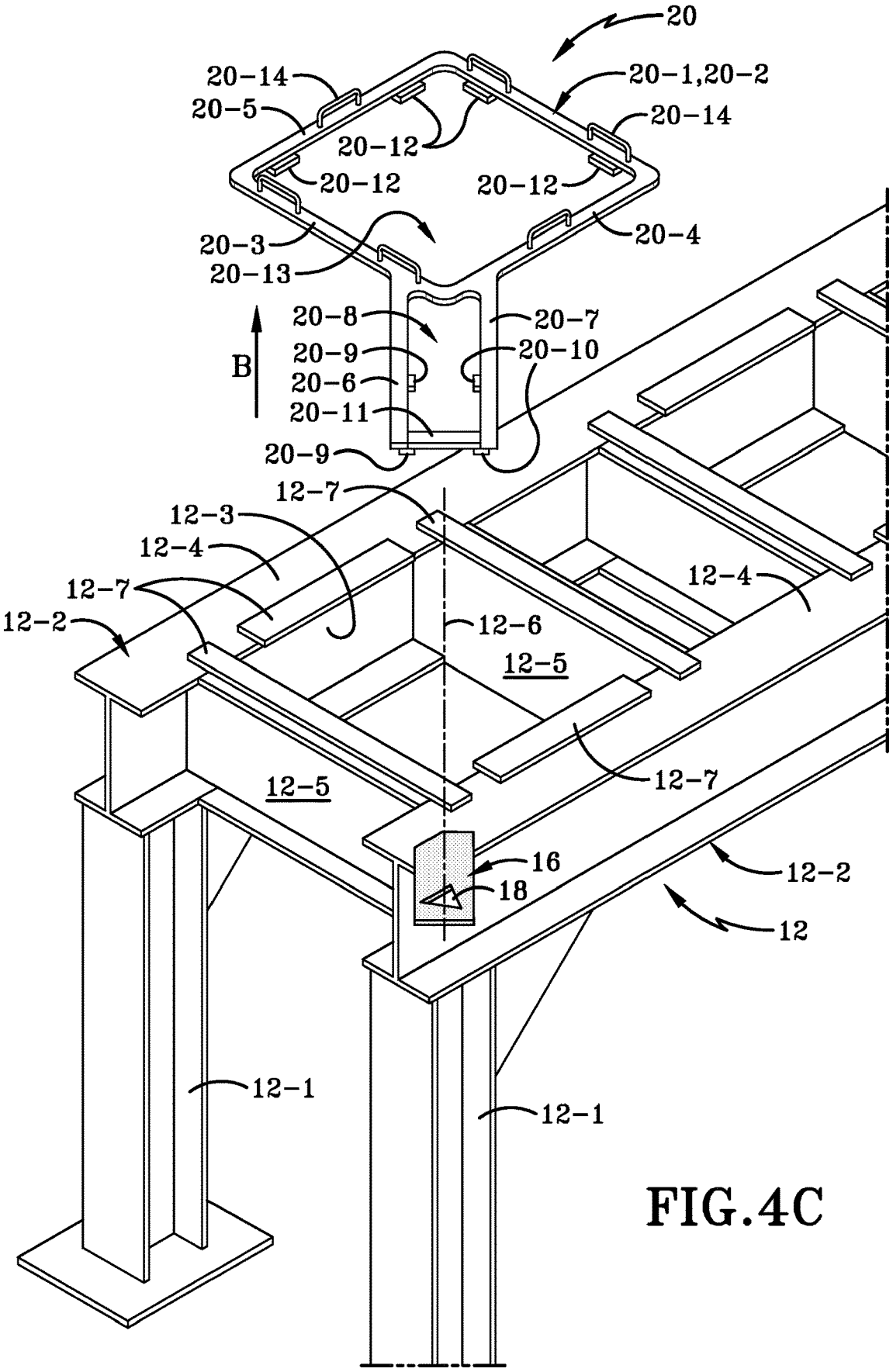
FIG. 4C is an operational perspective view of the target position fixture removed from the stand or rack after having installed the target plate.

FIG. 4A-FIG. 4C depict the installation of the target plate 16 onto the stand 12. To install the target plate 16 on the upper surface 12-4 of one of the longitudinal supports 12-2 of stand 12, a target position fixture 20 may be utilized. The target position fixture 20 includes a generally square or rectangular frame 20-1 composed of a first member 20-2 and a second member 20-3 that are aligned in the transverse direction and parallel to each other, and a third member 20-4 and a fifth member 20-5 that are parallel to each other and aligned in the longitudinal direction, wherein the third and fourth members are perpendicular to the first and second members to define and generally rectangular or square shape of frame 20-1. The frame 20-1 includes a pair of arms, namely a first arm 20-6 and a second arm 20-7 that are parallel to each other and extend outward from the frame 20-1 in a cantilevered manner. The frame 20 is configured to fit atop the shims 12-7 and traverse the perimeter of the opening 12-3 such that the diagonal axis 12-6 extends centrally between the first arm 20-6 and the second arm 20-7. As such, the first arm 20-6 and the second arm 20-7 extend cantilevered and outward from one of the corners of the frame 20-1. In the shown embodiment, the first and second arms 20-6, 20-7 extend in a cantilevered manner diagonally along the diagonal axis 12-6 from the corner located between the third member 20-4 and the second member 20-3. A space 20-8 is defined between the first arm 20-6 and the second arm 20-7.

As shown in FIG. 4A, the space 20-8 accommodates and receives the target plate 16 therein. Target plate 16 is centered and aligned within space 20-8 by the a pair of alignment tabs 20-9 and 20-10. Target plate 16 is clamped to the bottom surface of a support or linear member 20-11 and thus is in the same plane as the pair of tabs 20-9, 20-10). The installer may tack weld around the perimeter of target plate 16 while the position fixture 20 is in place. Then, the installer may remove the clamp holding linear member 20-11 to plate 16. Then, the installer removes the fixture 20 to finish welding the target plate 16 to the frame 12, particularly to the longitudinal support 12-2.

Target position fixture 20 may further include centering members on the frame 20-1. More particularly, there may be a plurality of centering tabs 20-12 on the frame members 20-2, 20-3, 20-4, and 20-5 that are used to center and position the target position fixture atop the shims 12-7 and within the opening 12-3 of stand 12. The centering tabs may also receive a cover and support the cover (not shown) which would allow the central aperture 20-3 of the defined by the frame 20-1 if desired to be covered. Further, there may be handles 20-14 that extend upward from the upper surface of frame 20-1 of target position fixture 20.

To install the target plate 16 on the upper surface 12-4 of one of the longitudinal supports 12-2 of stand 12, the target position fixture 20 will receive the target plate 16 between the first arm 20-6 and the second arm 20-7 and center the target plate 16 by first tab 20-9 and the second tab 20-10. The target position fixture 20 is lowered downwardly as indicated by arrow A towards one of the openings 12-3 defined in the stand 12.

FIG. 4B depicts the target position fixture 20 installed on the shims 12-7 surrounding an opening 12-3 on the stand 12. With the target position fixture 20 attached or removably installed on the stand 12, the lower surface 16-6 of the target plate 16 contacts the upper surface 12-4 of the longitudinal support 12-2. The edge 16-7 defining the truncated corner of the target plate 16 is aligned parallel or collinear with a longitudinal center line of one of the longitudinal supports 12-2. Then, the target plate 16 may be fixedly connected to the longitudinal support 12-2. In one example, the target plate 16 is welded to the upper surface 12-4 of the longitudinal support 12-2. The target position fixture ensures that when the target plate 16 is welded to the upper surface 12-4 of the longitudinal support 12-2, that the center 18-3 of the shape 18 is aligned with the diagonal axis 12-6.

FIG. 4C depicts that the target position fixture 20 may be removed as indicated by arrow B and leaving behind the target plate 16 in a fixed relationship relative to the center of the aperture in 12-3 which will be described in greater detail herein to locate the center of the opening 12-3 or the center 14-4 of one of the mill rolls 14 in order to eliminate or reduce wheel float on the crane that is used to pick up or place the vertically stored mill roll 14 on the stand 12.

Having thus described the configuration of portions of system 10, reference will be made to the operation of a crane 22 and how it utilizes the target plate 16 defining the symbol or shape 18 to locate the center 14-4 of the mill roll that is to be picked up or placed onto the stand 12 in a manner that will eliminate wheel float of the crane 22.

Figure 5A:
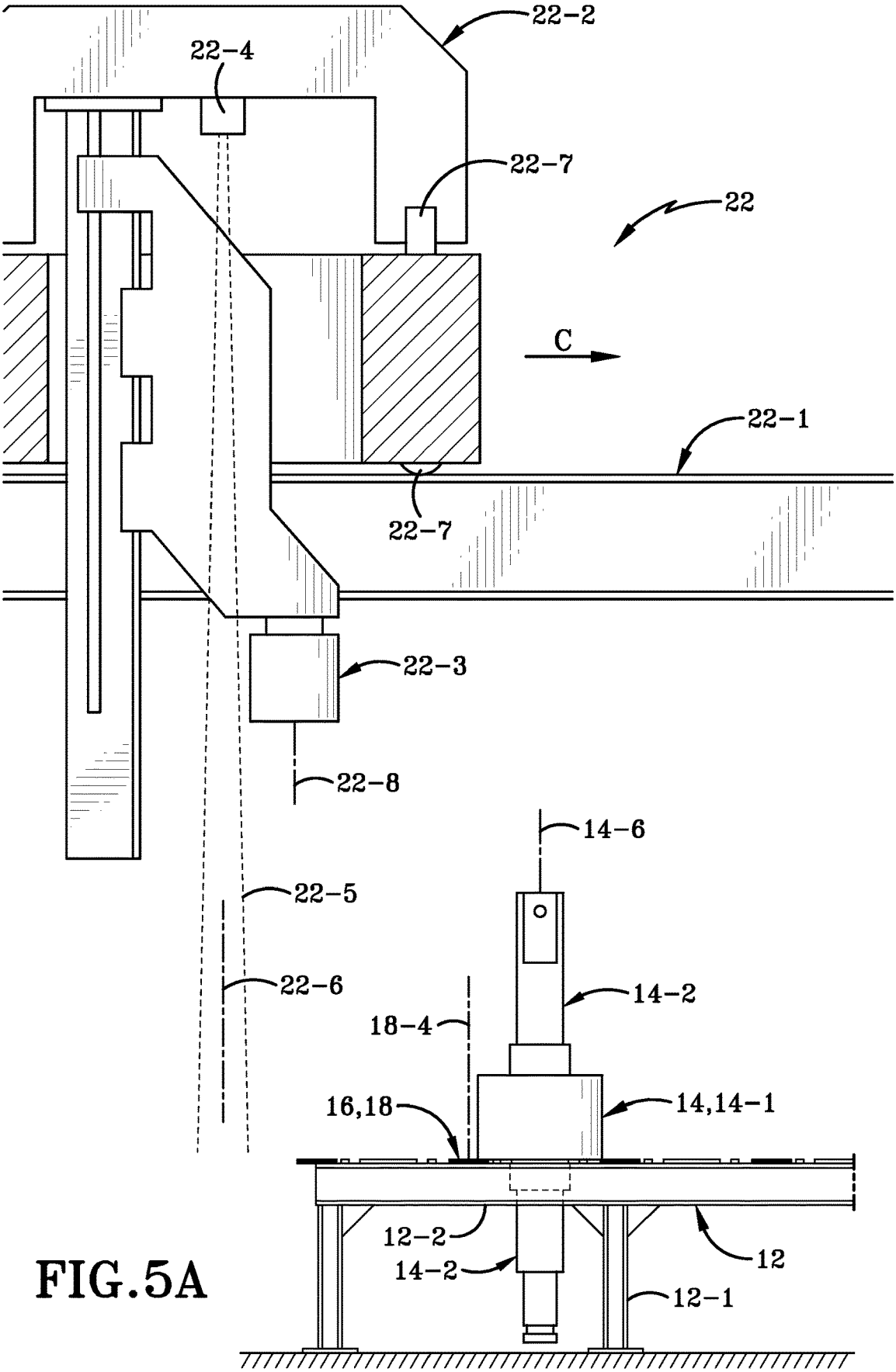
FIG. 5A is an operational side elevation view of an exemplary system with a crane located above the stand or rack storing a vertically oriented mill roll.

FIG. 5A depicts that the crane 22 includes rails 22-1 along which a bridge and/or trolley 22-2 travels. The trolley 22-2 carries a grasping and lifting device 22-3 (which may include a hoist) that is configured to carry the mill roll 14 to various locations within a factory or manufacturing facility. The trolley 22-2 carries a sensor 22-4 that is in operative communication with the shape 18 on target plate 16. In one particular embodiment the sensor 22-4 is an optical sensor having a field of view 22-5. The field of view 22-5 has a center 22-6. The sensor 22-4 and its field of view 22-5 is calibrated based on the positioning of the sensor 22-4 on trolley 22-2. The sensor 22-4 is operative to center the grasping and lifting device 22-3 over the center 14-5 and coaxial with axis 14-6 to thereby eliminate the wheel float caused by one or more wheels 22-7 that effectuates movement of the trolley 22-2 along the rails 22-1 of crane 22. The wheels may allow the trolley to move in a two axis plane, namely in a longitudinal direction relative to the stand 12 and a transverse direction relative to the stand 12.

Figure 5B:
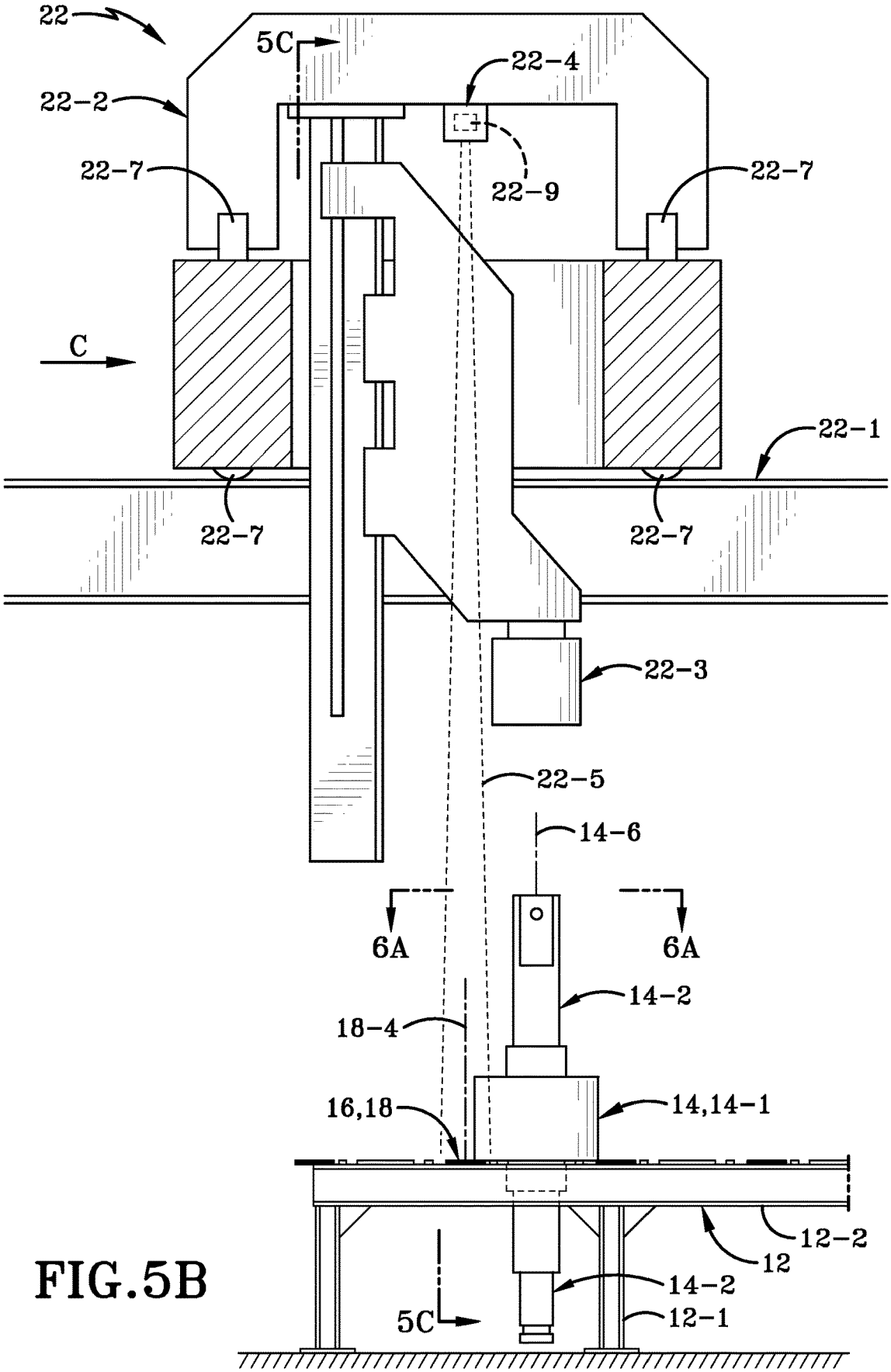
FIG. 5B is an operational side elevation view of the exemplary system with a sensor on the crane locating the shape or symbol on the target plate.
Figure 5C:
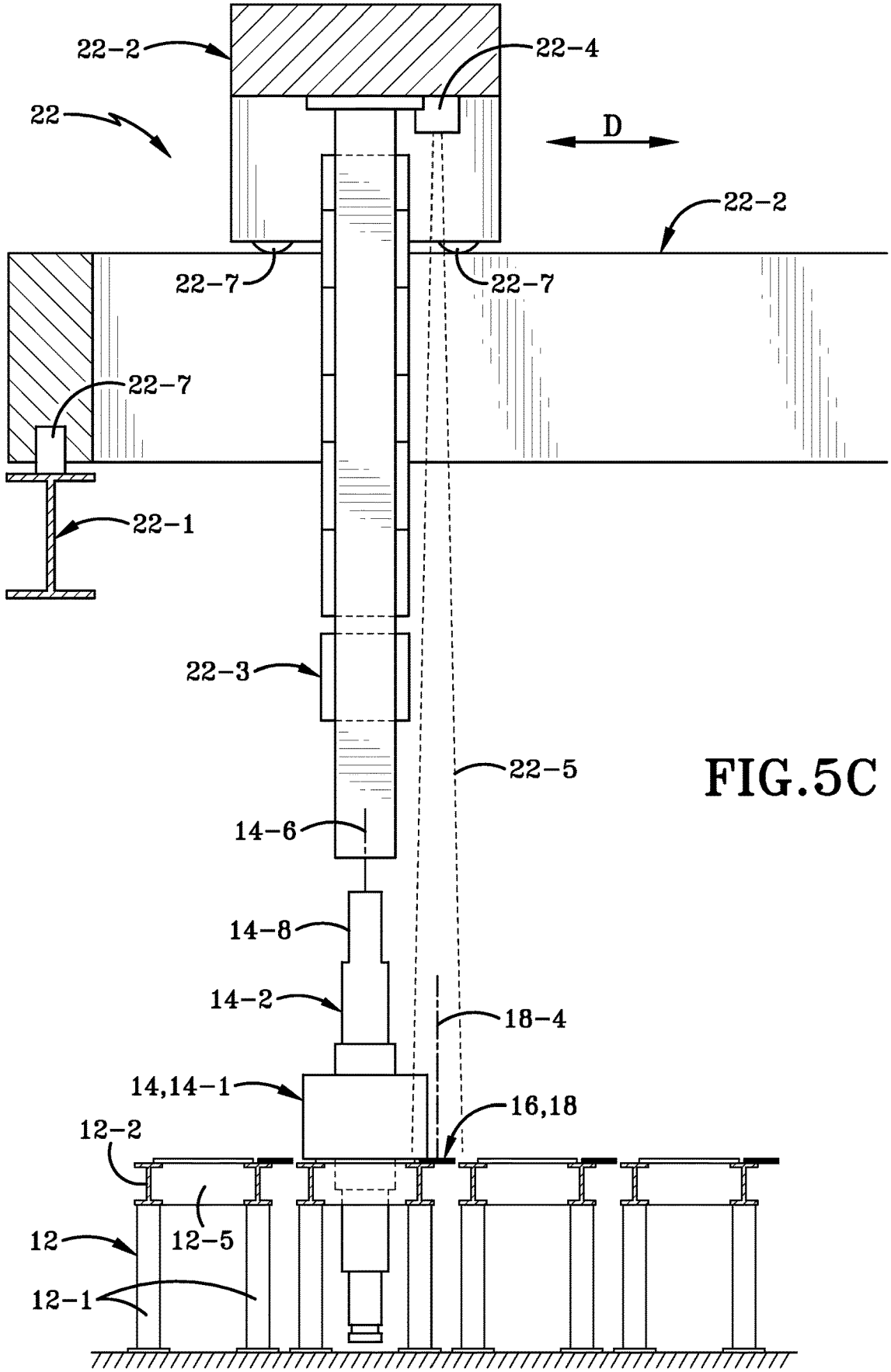
FIG. 5C is an operational end elevation view of the exemplary system taken along line 5C-5C in FIG. 5B.

For example, as depicted in FIG. 5A, the trolley 22-2 of crane 20 is moving in a longitudinal direction as indicated by arrow C. With the trolley 22-2 moving in the longitudinal direction indicated by arrow C, the sensor 22-4 is directing its field of view 22-5 downward towards the stand 12 supporting the roll 14 in a vertical position or orientation. FIG. 5B depicts that the trolley 22-4 continues to move in the direction of arrow C until the field of view 22-5 of sensor 22-4 encompasses a vertical axis 18-4 corresponding to the center 18-3 of the shape 18 located on the target plate 16. If necessary, as depicted in FIG. 5C, the trolley 22 may move in the transverse direction as indicated by arrow D to ensure that the vertical axis 18-4 associated with the center 18-3 of the shape 18 is located within the field of view 22-5.

Figure 6A:
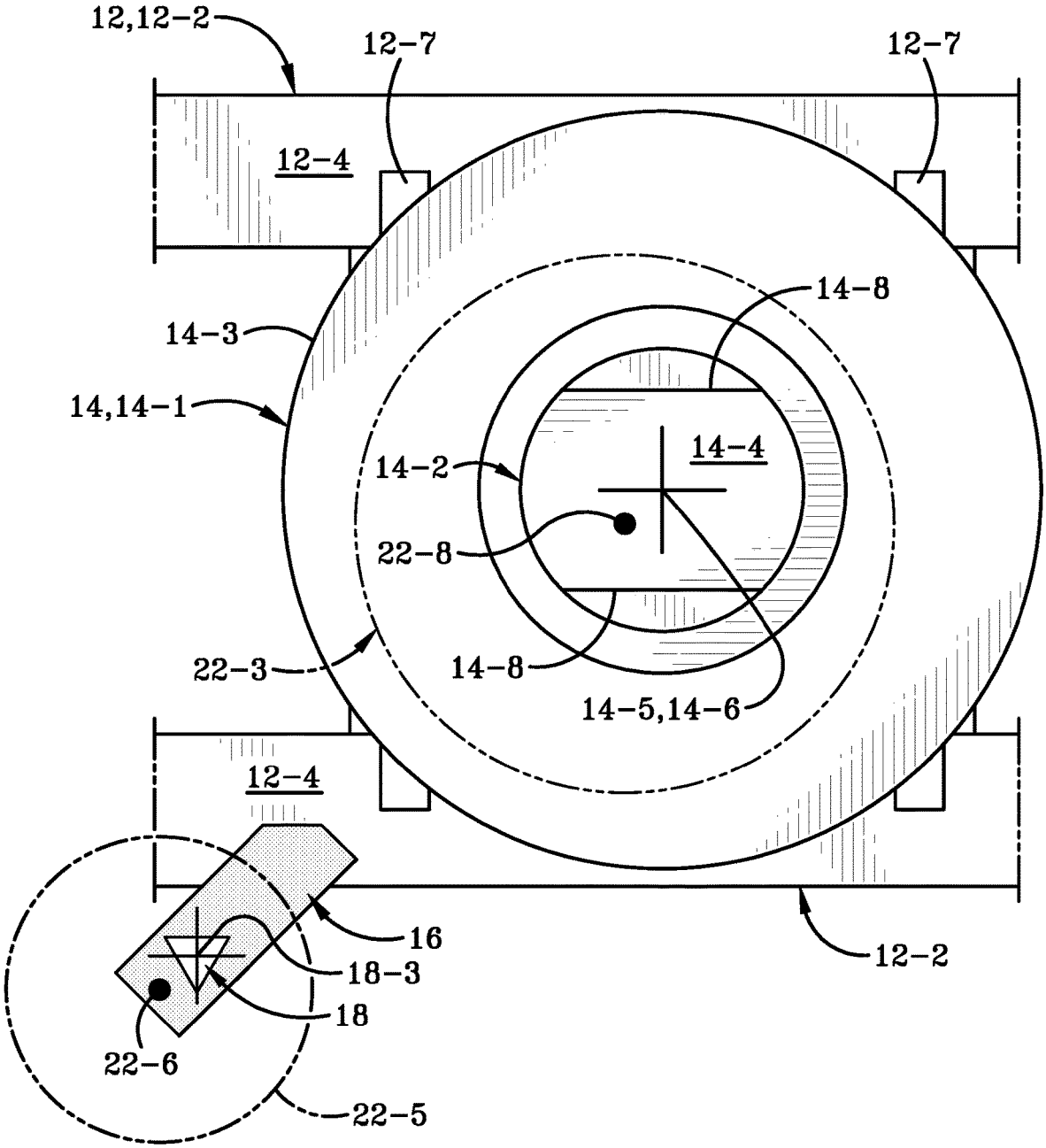
FIG. 6A is an operational top plan view of the sensor on the crane locating the shape or symbol on the target plate taken along line 6A-6A in FIG. 5B.
Figure 6B:
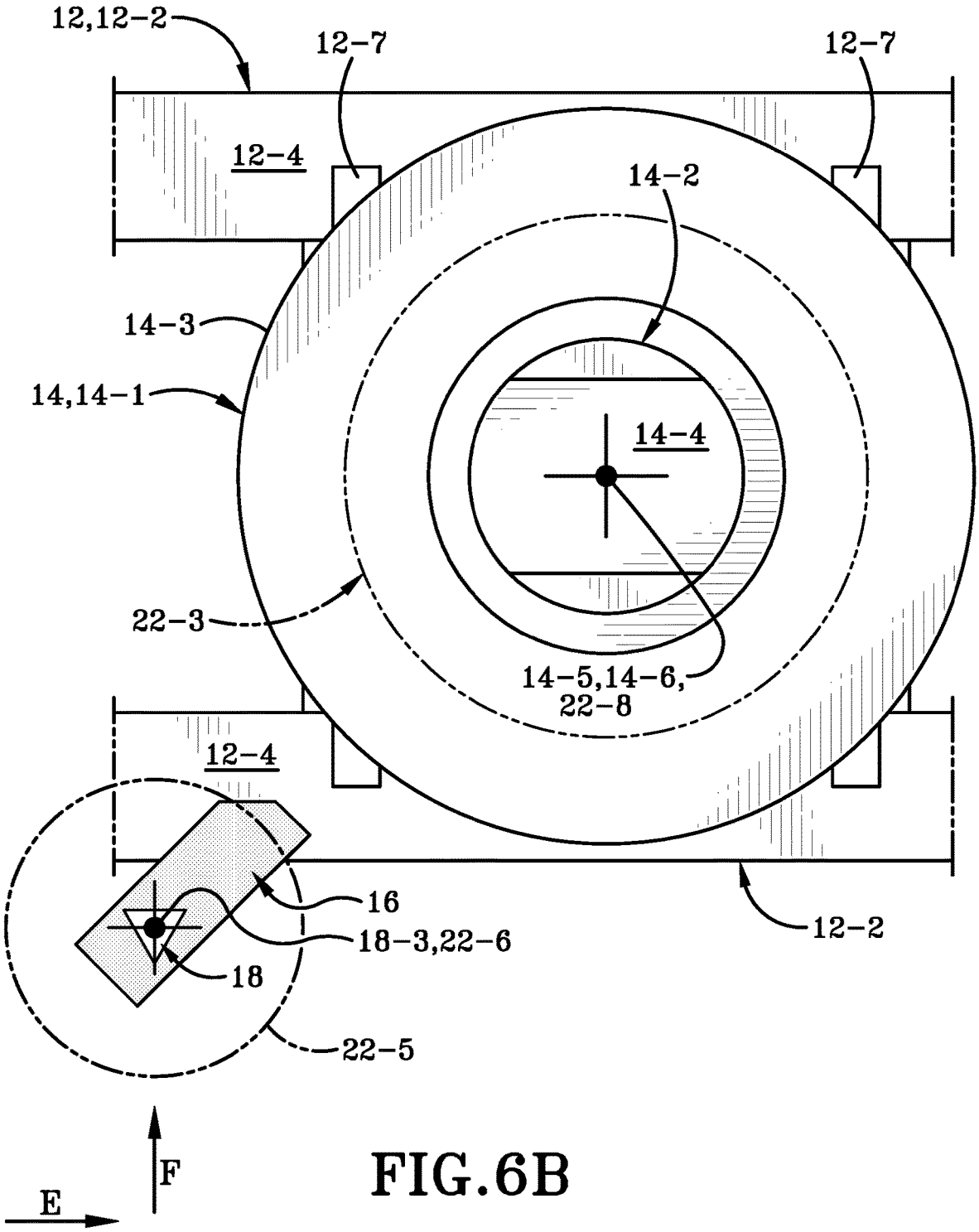
FIG. 6B is an operational top plan view of the sensor on the crane having located the shape or symbol on the target plate and correcting or compensating for wheel float to locate the center of the vertically stored mill roll.

FIG. 6A and FIG. 6B depict the operation of centering the grasping and lifting device 22-3 above the center 14-5 and along axis 14-6 of trunnion 14-2.

FIG. 6A depicts that the center 22-6 of the field of view 22-5 is adjacent the target shape 18, but it is not directly aligned with the center 18-3 of target shape 18. Because of this arrangement, the center 22-8 of the grasping and lifting device 22-3 is off center from the center 14-5 and axis 14-6 of the trunnion 14-2. The sensor works in communication with the crane programmable logic controller (PLC) 22-9 having wheel float logic to align the center 22-6 of the field of view 22-5 with the center 18-3 of the shape 18. This will result in the center 22-8 of the grasping and lifting device 22-3 to be aligned with the center 14-5 of the trunnion 14-2 and coaxial with axis 14-6.

For example, as shown in FIG. 6B, the sensor 22-4 will have observed that the center 22-6 of the FOV 22-5 is offset from the center 18-3 of shape 18. The crane PLC 22-9 or wheel float logic will calculate the two axis movement that is needed to align the center 22-6 of the FOV 22-5 with the center 18-3 of the shape 18. FIG. 6B depicts that the crane PLC 22-9 or wheel float logic has instructed motors that are in operative communication with the wheels 22-7 on the bridge or trolley 22-2 to move in the longitudinal direction a first distance as indicated by arrow E and in the transverse direction, a second distance as indicated by arrow F. The movement of the wheels 22-7 to move the trolley 22-2 and/or the bridge in the first distance as indicated by arrow E and the second distance as indicated by arrow F will align the center 22-6 of the field of view 22-5 with the center 18-3 of the shape 18. This causes the center of the center 22-8 of the grasping and lifting device 22-3 to be aligned with the center 14-5 of trunnion 14-2.

Figure 7:
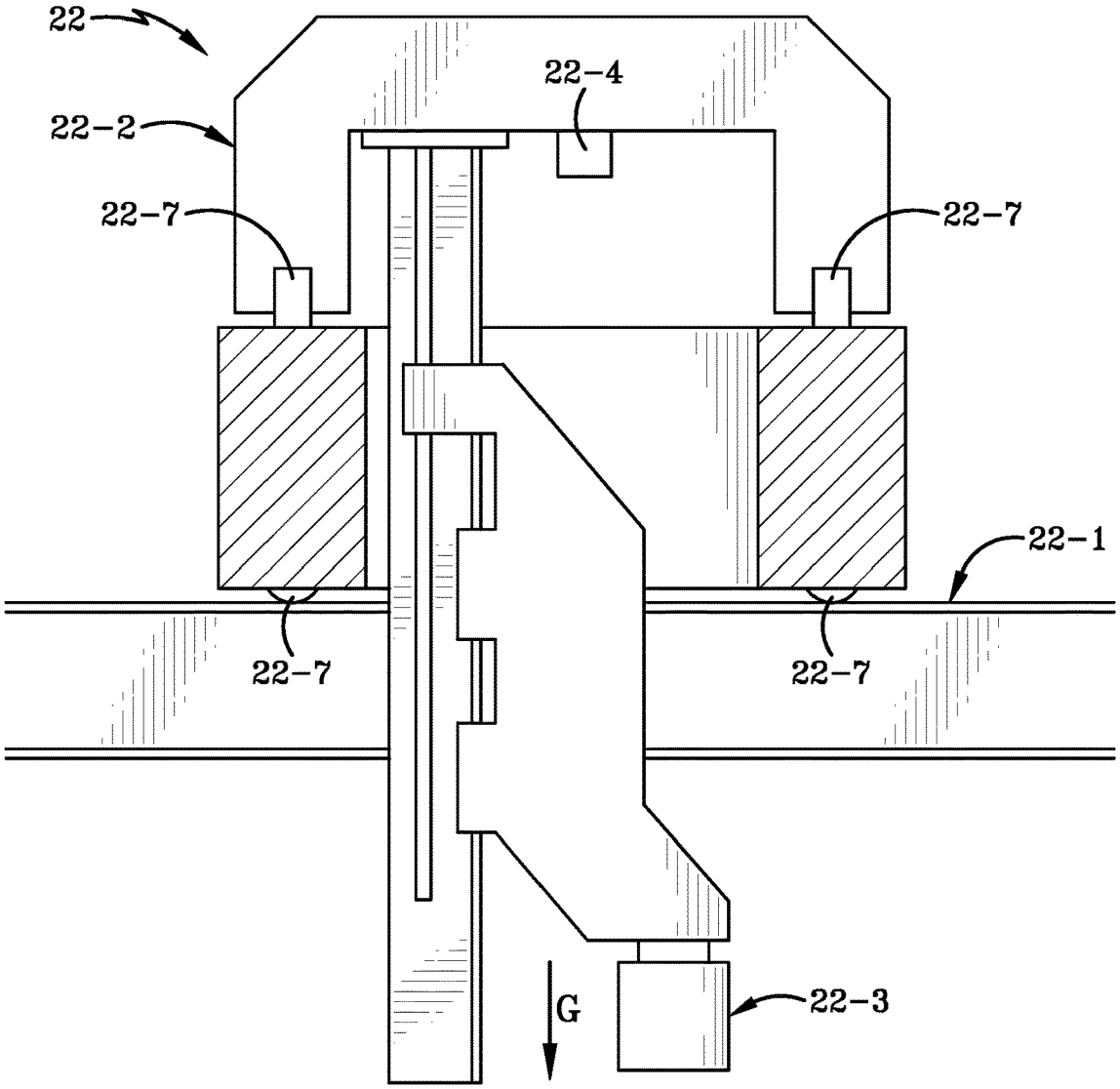
FIG. 7 is an operational side elevation view of the exemplary system with the grasping and lifting device being located directly above the vertically stored mill roll.
Figure 7:
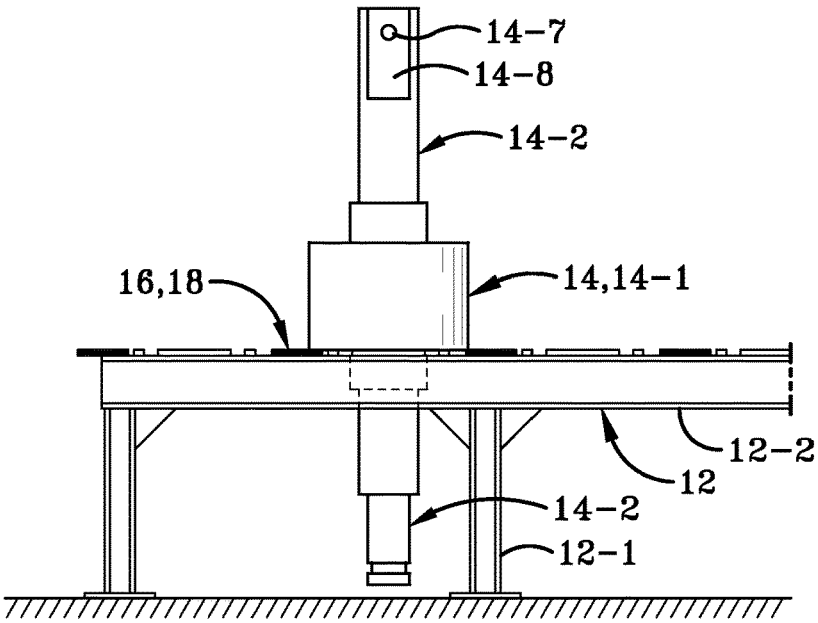

Once the centers have been aligned, the grasping and lifting device 22-3 may be lowered in the vertical direction as indicated by arrow G, as shown in FIG. 7. The grasping and lifting device may be continued to be lowered in the direction of arrow G until the grasping and lifting device 22-3 engages the elevated end of the trunnion 14-2. In one embodiment in order to lift the roll 14 by the trunnion 14-2, the grasping and lifting device 22-3 will insert a rod through the transverse bore 14-7.

Figure 8:
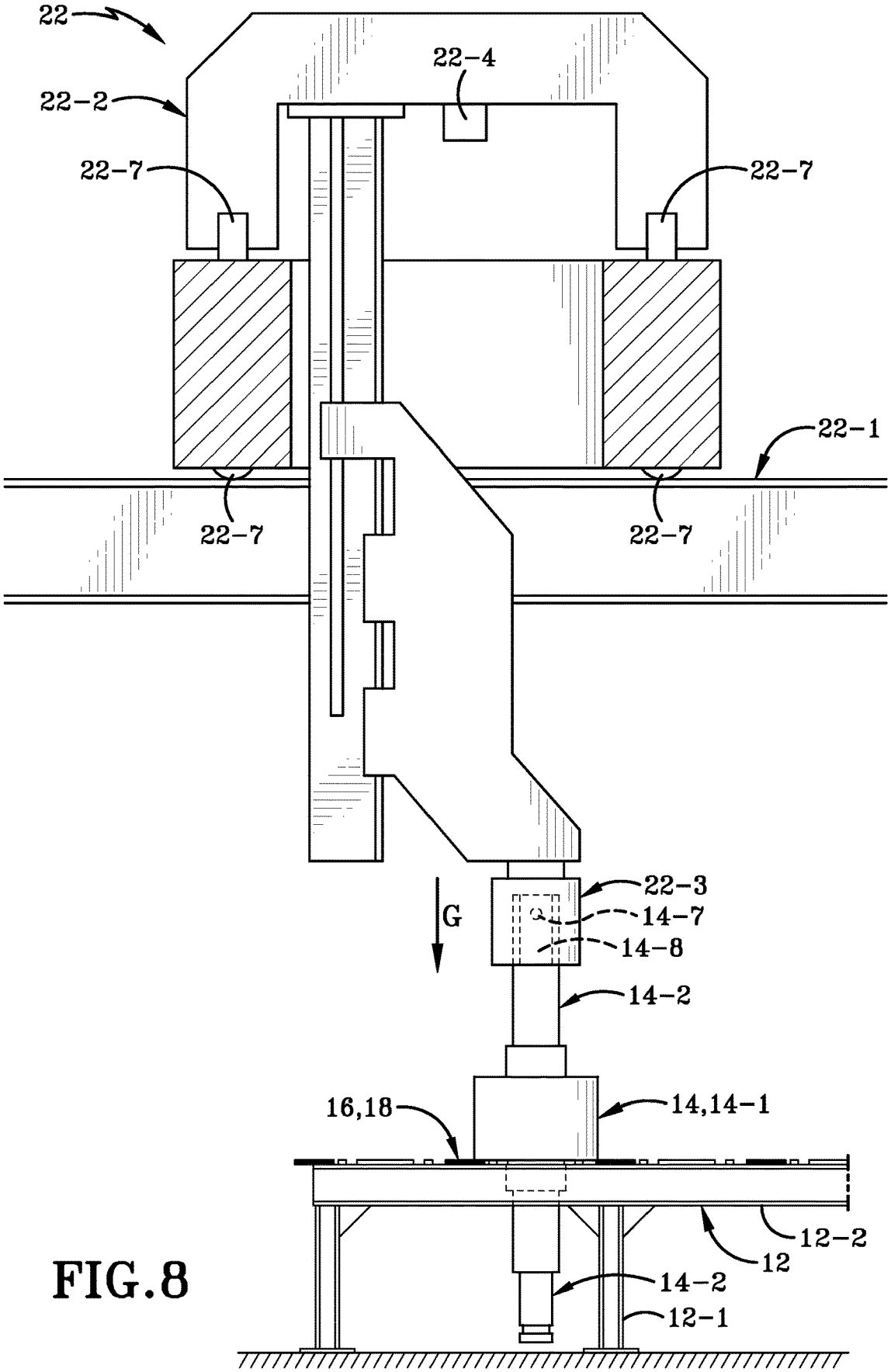
FIG. 8 is an operational side elevation view of the exemplary system having lowered the grasping and lifting device and connecting with the vertically stored mill roll so that the mill roll may be lifted and carried to another location.

As shown in FIG. 8, the grasping and lifting device 22-3 is engaged with the trunnion 14-2. The engagement is accomplished by inserting an arbor or pin through the bore 14-7 and maintaining that engagement during the lifting and transfer of mill roll 14. The grasping and lifting device 22-3 may be raised upward in the vertical direction, opposite that of arrow G, to lift the roll 14 out of its supported relationship atop stand 12 and move the roll 14 to another location in the manufacturing facility.

FIG. 9A-FIG. 11 depict a similar process of locating the center of the shape 18 to place a roll 14 that is being carried by the trolley into an opening 12-3 on the stand 12.

Figure 9A:
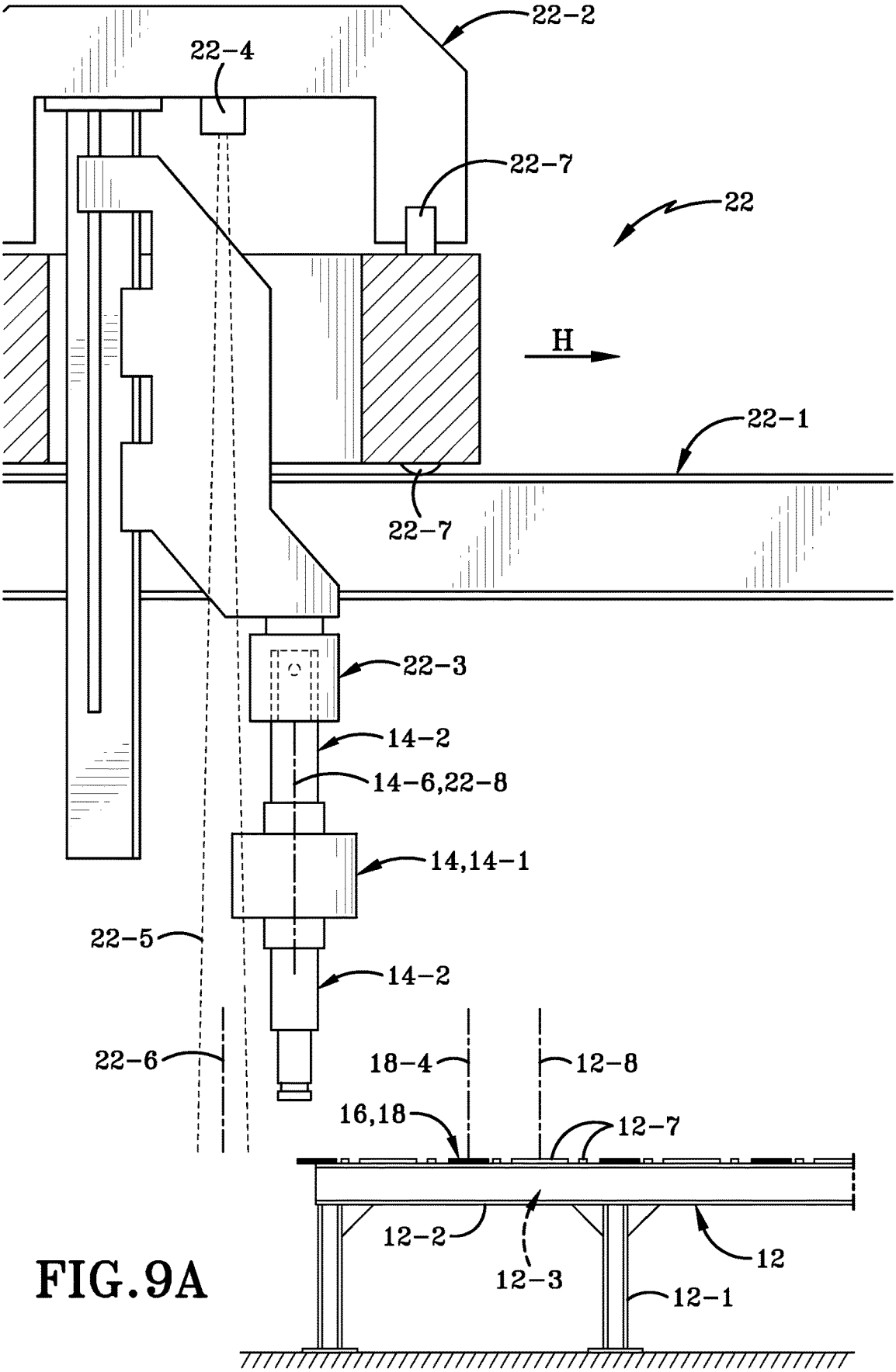
FIG. 9A is an operational side elevation view of the exemplary system having a vertically oriented mill roll being carried by the grasping and lifting device that is moving above the stand or rack.
Figure 9B:
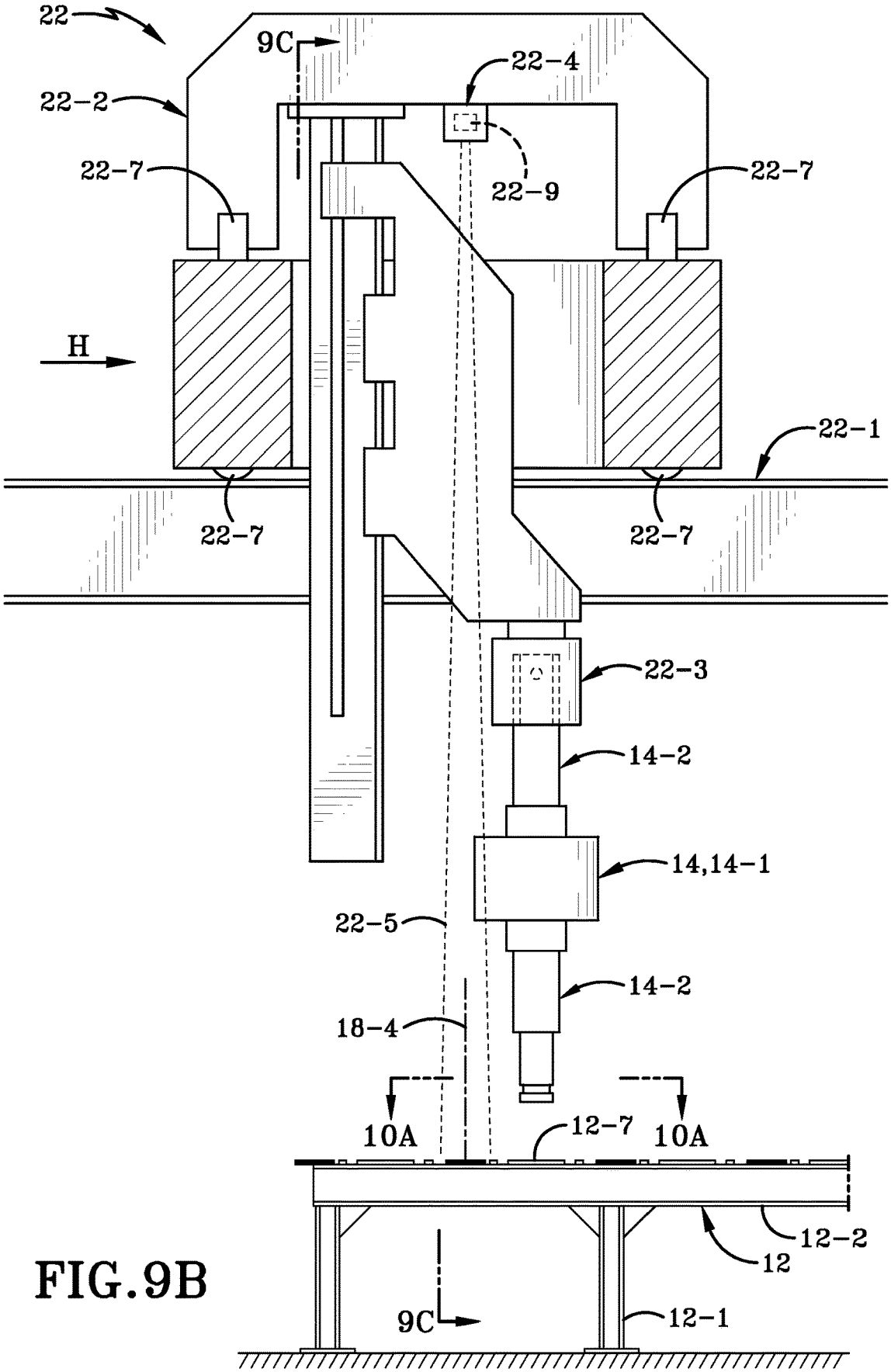
FIG. 9B is an operational side elevation view of the exemplary system having the vertically oriented mill roll being carried by the grasping and lifting device while a sensor is detecting the target plate so the mill roll may be returned to the stand or rack.
Figure 9C:
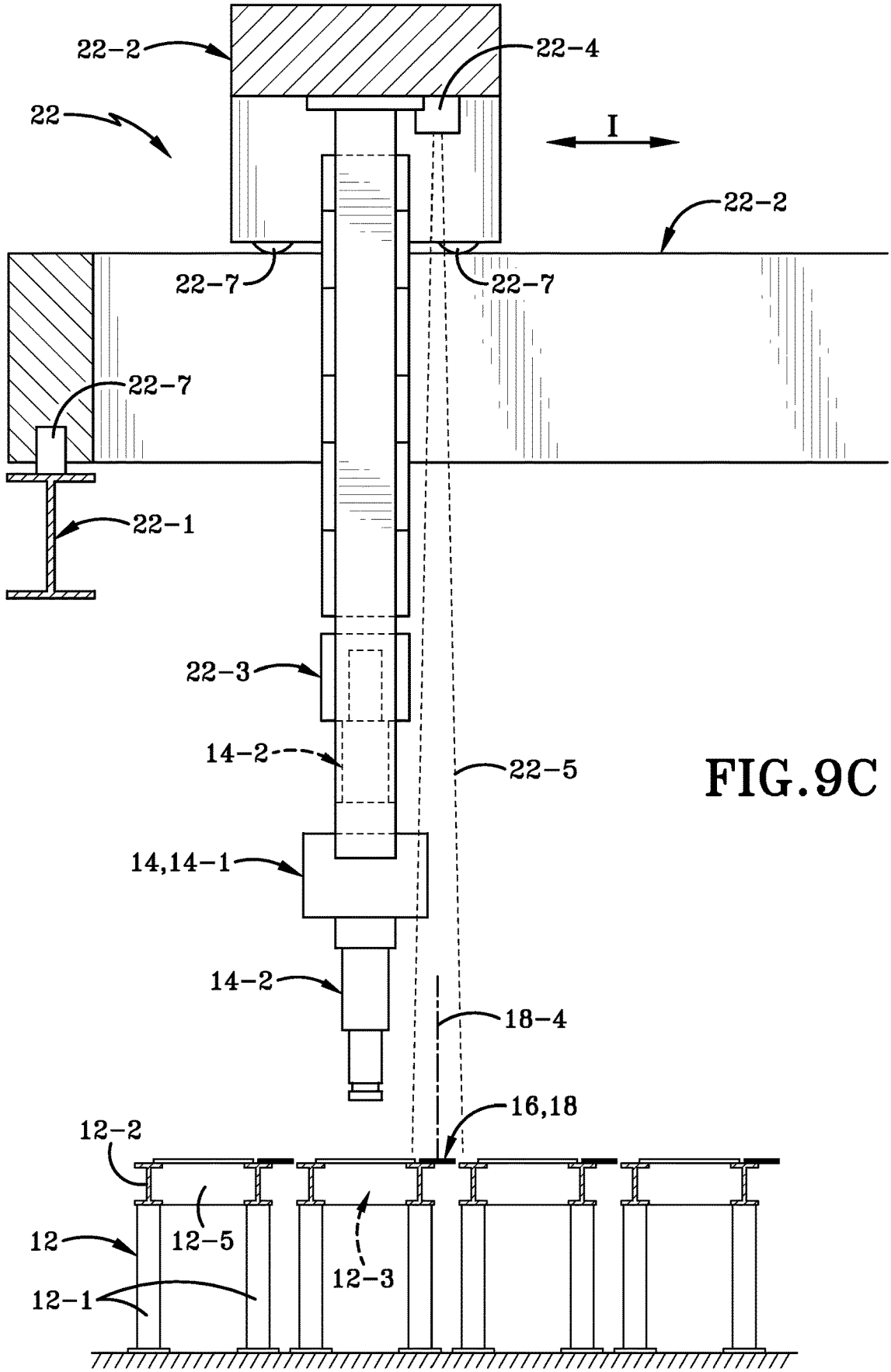
FIG. 9C is an operation end elevation view of the exemplary system having the vertically oriented mill roll being carried by the grasping and lifting device while a sensor is detecting the target plate so the mill roll may be returned to the stand or rack taken along line 9C-9C in FIG. 9B.

As shown in FIG. 9A, the grasping and lifting device 22-3 is engaged with the roll 14 by a pin being inserted through the bore 14-7. The trolley 22-2 is moving longitudinally or in the longitudinal direction as indicated by arrow H. The field of view of sensor 22-4 is also moving in the longitudinal direction represented by arrow H inasmuch as the sensor 22-4 is rigidly secured to trolley 22-2 and moves in unison therewith. The trolley continues to move in the direction of arrow H until the field of view 22-5 is located above the center 18-3 of shape 18 as indicated by the axis 18-4 through the center 18-3 being within the field of view 22-5, as shown in FIG. 9B. As shown in FIG. 9C, the trolley may move in the transverse direction as indicated by arrow I to ensure that the axis 18-4 associated with the center 18-3 of shape 18 is within the field of view 22-5.

Figure 10A:
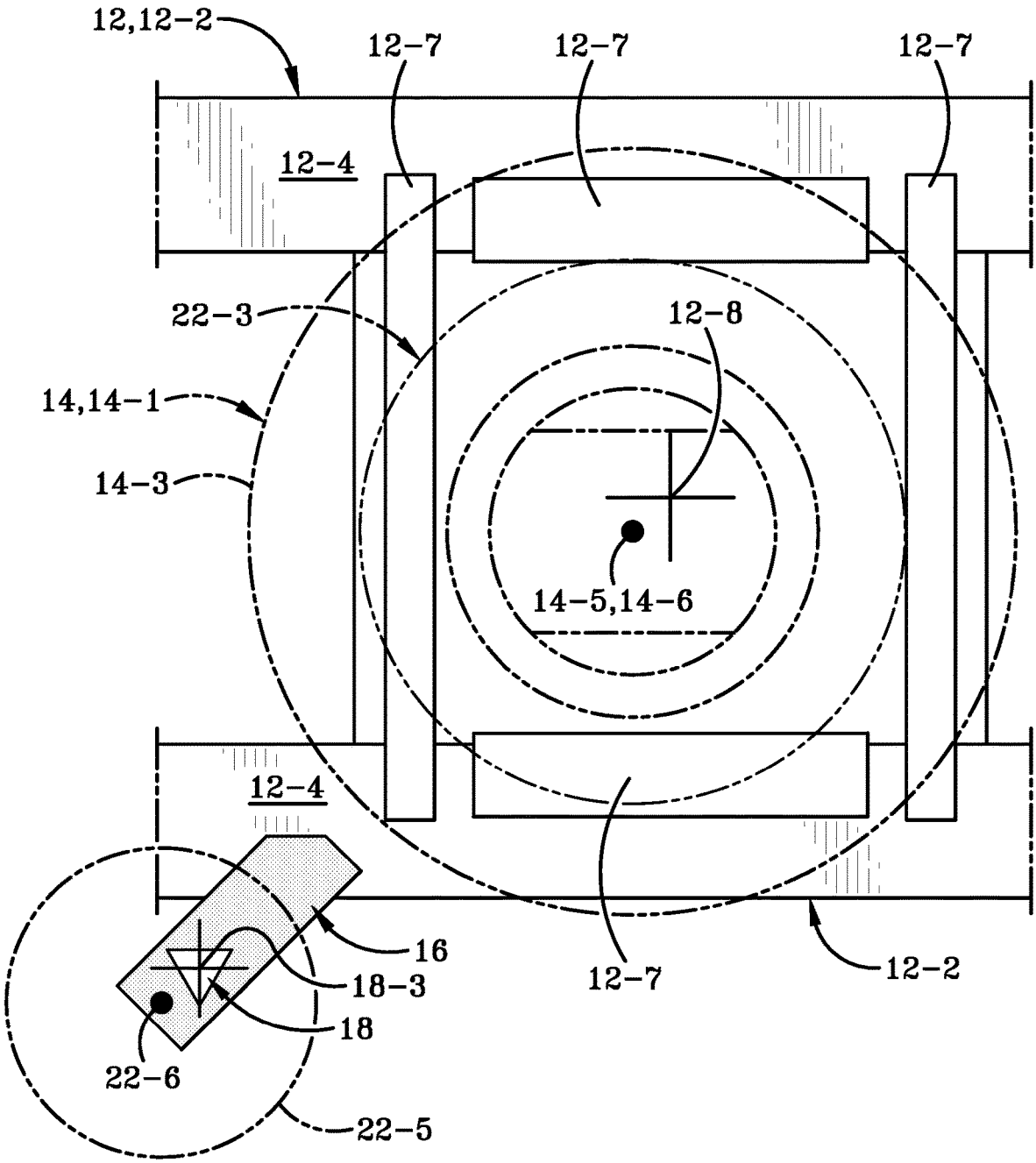
FIG. 10A is an operational top plan view of the sensor on the crane locating the shape or symbol on the target plate taken along line 10A-10A in FIG. 9B for placement of the mill roll on the rack or stand.
Figure 10B:
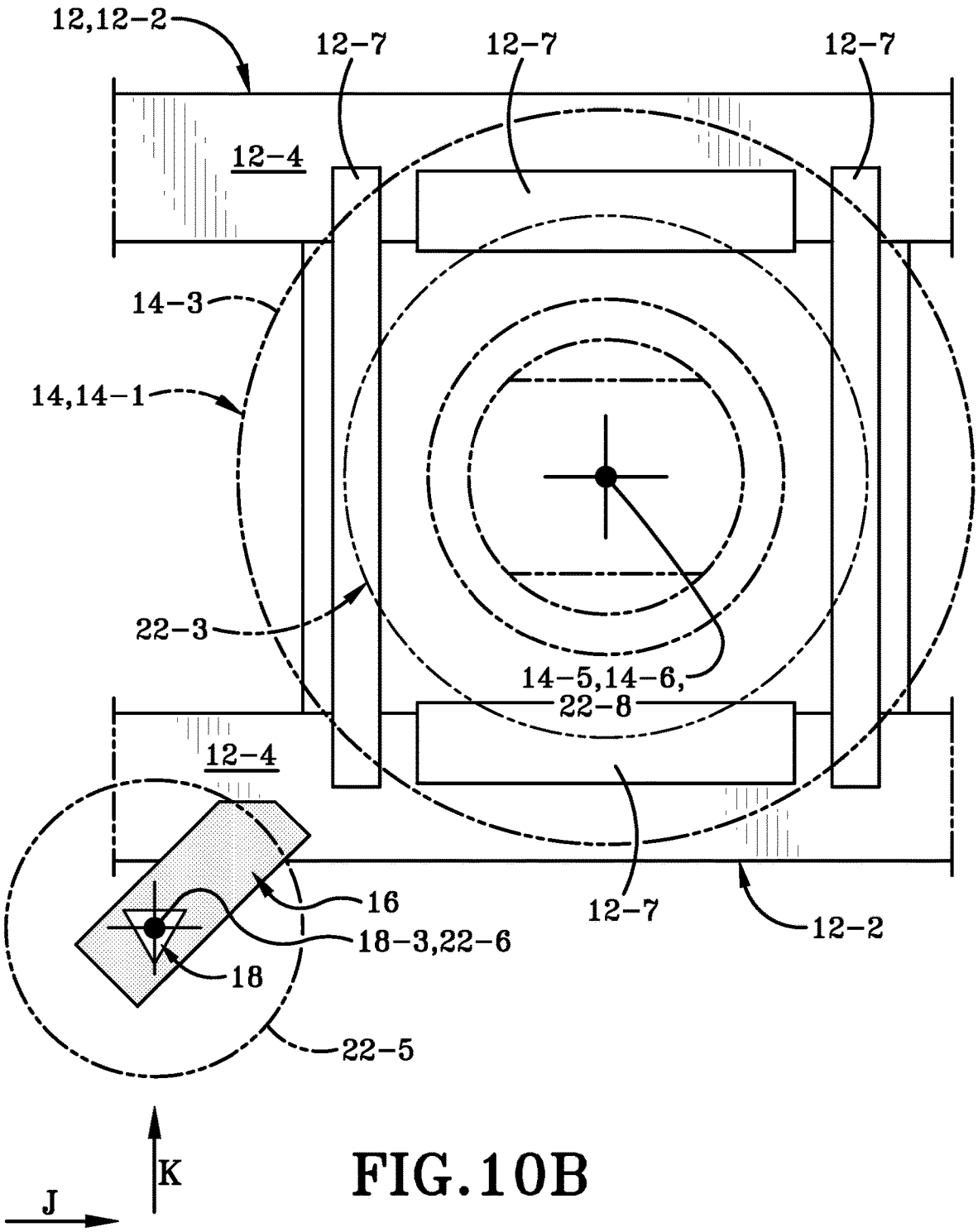
FIG. 10B is an operational top plan view of the sensor on the crane having located the shape or symbol on the target plate and correcting or compensating for wheel float to locate the center of the vertically stored mill roll for placement of the mill roll on the rack or stand.

FIG. 10A and FIG. 10B depict the operation of crane PLC 22-9 or wheel float logic to locate the center 12-8 of the opening 12-3. More particularly, crane PLC 22-9 or wheel float logic determines that the field of view 22-5 and the center 22-6 of the field of view is off center from the center 18-3 of shape 18. This results in the center 14-5 of the trunnion 14-2 which is held vertically above the opening 12-3 being off center from the center of the opening 12-3. The crane PLC 22-9 or wheel float logic calculates the two axis directional movement that is needed to align the center 22-6 of the field of view 22.5 over the center 18-3 of shape 18. FIG. 10B depicts this movement and instructions that are provided by PLC 22-9 to the motors to move the center 22-6 in alignment with the center 18-3 as indicated by arrow J and arrow K.

Figure 11:
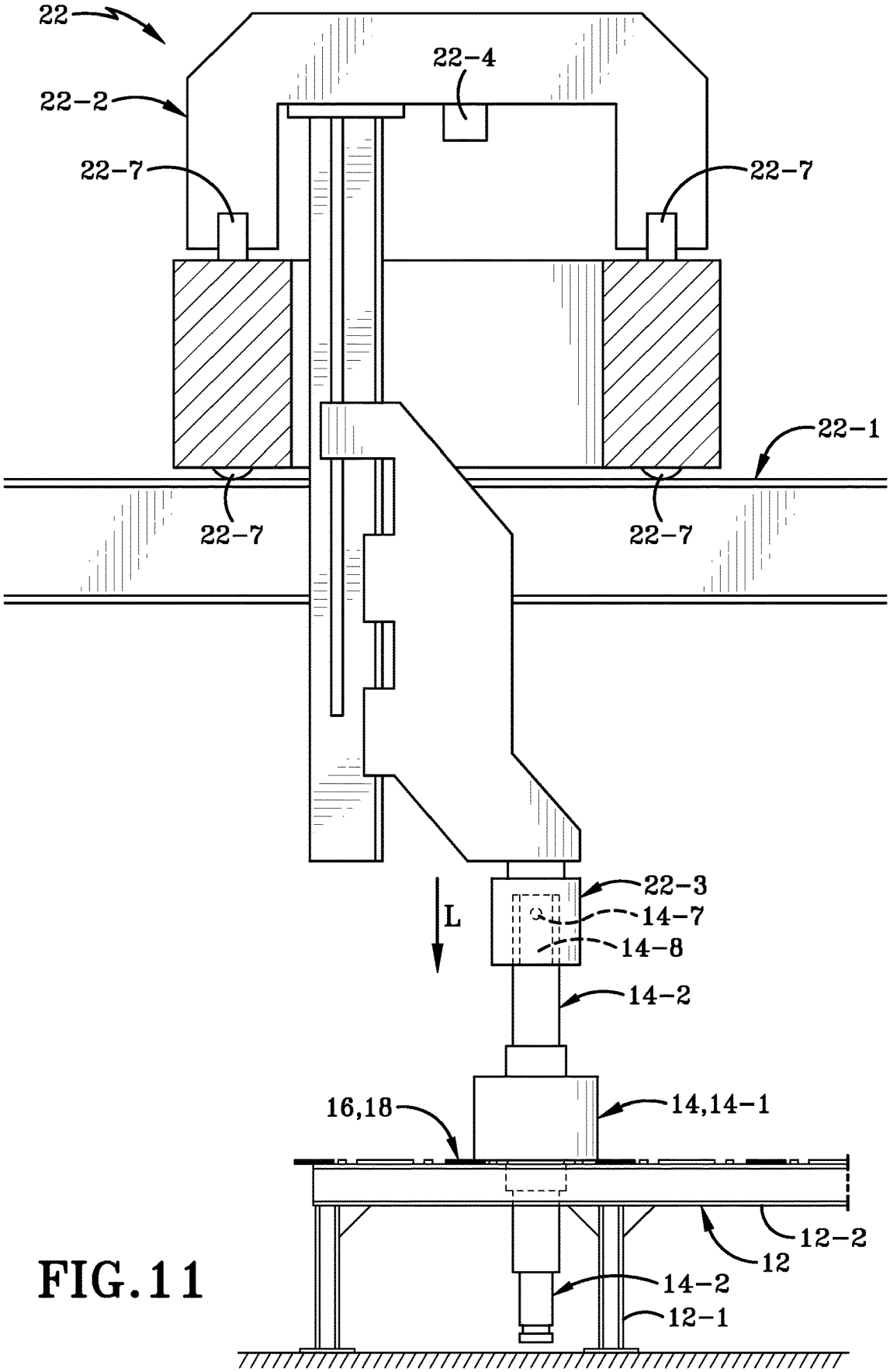
FIG. 11 is an operational side elevation view of the exemplary system having lowered the grasping and lifting device to place the mill roll on the stand or rack, and disconnecting the grasping and lifting device from the vertically stored mill roll so that the mill roll may be retained and centered on the stand or rack in a vertical orientation.

As depicted in FIG. 11, when the roll 14 is aligned with the center 12-8 of the opening 12-3, the grasping and lifting device 22-3 may be lowered as indicated by arrow L to place and engage one of the sidewalls 14-1 of roll 14 onto the stand 12. More particularly, the sidewall 14-1 is engaged with the shims 12-7 and supported by both the longitudinal support 12-2 and the transverse support 12.5. Thereafter, the pin on the grasping and lifting device 22-3 may be removed from the bore 14-6 and the grasping and lifting device may disengage the trunnion 14-2, leaving the trunnion stored in a vertical position such that the roll remains in a vertically stored orientation with one trunnion 14-2 defining an elevated end and an opposing trunnion 14-2 extending downward from the longitudinal support 12-2.

Having thus described the operation of the system, reference is now made to a description of the programming thereof that is to occur prior to the system's operation. More particularly, reference is made to the programming and calibration of the sensor relative to the shape 18 so that the crane can properly lift the roll 14.

As detailed herein, the crane for the vertical mill roll storage techniques detailed herein utilizes uses sensor 22-4, such as a smart camera, to detect the relative position of the roll stand 12 along the bridge and trolley axes. The target plate 16 having shape 18 functions as a visual flag and is affixed near one of the outer corners of an opening 12-3 on the stand 12. Shape 18 is well-defined and allows the sensor to locate and identify the shape type and position within the sensor's FOV 22-5.

The sensor 22-4 is programmed with a set of instructions stored in crane PLC 22-9 or wheel float logic or another component of the system or assembly having a non-transitory computer readable storage medium, wherein the instructions, when executed by a processor, are designed to detect the roll stand target plate 16 or flags. Each instruction may include a two-dimensional (2D) vector representation of a specific target plate shape or symbol 18 as well as a pre-defined procedure to detect the plate and calculate the stand's position relative to the crane.

Before commissioning, the sensor instructions may be prepared and tested in a lab environment. The sensor 22-4 is mounted in a fixed position and directed at a target plate located across the room. The sensor 22-5 is pointed horizontally in the lab rather than vertically for practical purposes. This allows the distance between the sensor and the test target plate to match the expected distance at final installation.

Once the sensor 22-4 is installed on the crane, the sensor's pitch and yaw are manually adjusted so that all stand target plates 16 are visible while the crane is centered over the corresponding stand 12. Since the mounting position can vary between flag or target 16 types, an effort should be made to ensure that the sensor position is aligned with the average center of all plates types combined.

The sensor 22-4 or crane PLC 22-9 or wheel float logic has signal transmission capabilities and sends position offset measurements to the crane PLC. The transmission may occur wired or wirelessly. Further, the position offset measurements may be provide in millimeter units, however any dimensional unit is possible. Before the sensor 22-4 can accurately convert its intrinsic pixel units to the required millimeter units, sensor 22-4 should be calibrated. Scale calibration is performed using a built-in tool provided by the camera or sensor manufacturer. Once calibration is complete, the resulting scale ratio is stored in the internal camera memory or alternatively in the crane PLC 22-9 or wheel float logic. From this point on all measurement values are defined in millimeter units or the selected unit if the user chooses a different defined unit.

Each instruction that is stored in the memory includes a model of the target plate shape or symbol 18. This model is a 2D vector line drawing in millimeter units. The origin of the model (i.e. the point at which x=0, y=0) is fixed at a predefined point on the plate 16 to ensure consistency across different instructions. This origin point is used as a model reference point during detection of the target plate 16.

When the crane PLC requests a position measurement from the sensor, the PLC specifies which instruction to use for evaluation. The sensor program then captures an image and searches for the model or shape associated with the instruction. The algorithm used to search for the model or shape is provided by the sensor manufacturer. If the model or shape is found, the sensor stores the x,y position of the detected model's model reference point relative to the top-left of the image (x=0, y=0), however the model reference point may be stored relative to other locations in the image. This offset is referred to as the flag or plate position. The sensor or PLC then calculates the stand position using the following formula:

$$\text{Stand position} = \text{flag position} - \text{instruction offset} + \text{global offset}. \quad \text{(Equation 1)}$$

The sensor sends the stand position to the crane PLC 22-9. The crane PLC 22-9 then uses the stand position to make any needed position corrections with the bridge and/or trolley.

There may be a need for offset calibration of the instructions. In this instance, the roll stand positions can vary along 3 axes: x, y, and z. These correspond to the crane's respective bridge, trolley, and hoist (e.g., the grasping and lifting device). Each plate instruction applies to a group of stands having a common plate cutout shape 18 and mount position relative to the x,y center of the stand. Once the sensor 22-4 is installed on the crane, each plate instruction is calibrated to determine the specific x,y offset in the sensor FOV 22-5 relative to the top-left (or another portion) of the image (x=0, y=0) while the crane's bridge and trolley are positioned directly over the center 12-8 of opening 12-3 of the roll stand 12 (i.e. the exact position required to interface with the roll). This offset is stored as an x,y pair in the recipe and referred to as the recipe offset.

It is expected that under normal operation the sensor mount could drift or be bumped out of alignment. To account for this, the sensor program allows maintenance personnel to set an x,y offset value that will be added to the instruction offset when calculating all stand positions. This x,y offset is referred to as the global offset. Once the sensor alignment is manually corrected, a software calibration should be performed using the following procedure. To calibrate the global offset, the crane is first manually positioned over the center 12-8 of one of the openings 12-3 of a roll stand at the exact position required to interface with the roll 14 (i.e. the crane grasping and lifting assembly is centered around the trunnion 14-2 of roll 13). Once the crane is in position, the sensor software calculates the global offset. The sensor detects the position of the target plate 16 as usual and then calculates and stores the global offset using the following formula:

$$\text{Global offset} = \text{flag position} - \text{recipe offset}. \quad \text{(Equation 2)}$$

The device, assembly, or system of the present disclosure may additionally include one or more other sensors sensor to sense or gather data pertaining to the surrounding environment or operation of the device, assembly, or system. Some exemplary sensors capable of being electronically coupled with the device, assembly, or system of the present disclosure (either directly connected to the device, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

The device, assembly, or system of the present disclosure may include wireless communication logic coupled to sensors on the device, assembly, or system. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wifi, ZigBee, MiWi, Bluetooth) for communication. In one example, each of the devices, assemblies, or systems of the present disclosure may have its own IP address and may communicate directly with a router or gateway. This would typically be the case if the communication protocol is WiFi.

In another example, a point-to-point communication protocol like MiWi or ZigBee is used. One or more of the device, assembly, or system of the present disclosure may serve as a repeater, or the devices, assemblies, or systems of the present disclosure may be connected together in a mesh network to relay signals from one device, assembly, or system to the next. However, the individual device, assembly, or system in this scheme typically would not have IP addresses of their own. Instead, one or more of the devices, assemblies, or system of the present disclosure communicates with a repeater that does have an IP address, or another type of address, identifier, or credential needed to communicate with an outside network. The repeater communicates with the router or gateway.

In either communication scheme, the router or gateway communicates with a communication network, such as the Internet, although in some embodiments, the communication network may be a private network that uses transmission control protocol/internet protocol (TCP/IP) and other common Internet protocols but does not interface with the broader Internet, or does so only selectively through a firewall.

The system that receives and processes signals from the device, assembly, or system of the present disclosure may differ from embodiment to embodiment. In one embodiment, alerts and signals from the device, assembly, or system of the present disclosure are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a production operations department. Thus, if a particular device, assembly, or system of the present disclosure creates an alert because of a data point gathered by one or more sensors, that alert can be sent, in e-mail or SMS form, directly to the individual responsible for fixing or monitoring it. Of course, e-mail and SMS are only two examples of communication methods that may be used; in other embodiments, different forms of communication may be used.

In other embodiments, alerts and other data from the sensors on the device, assembly, or system of the present disclosure may also be sent to a work tracking system that allows the individual, or the organization for which he or she works, to track the status of the various alerts that are received, to schedule movement of the rolls 14 within the production facility. The tracking of the movement of the rolls 14 can also predict or automatically generate the schedule for moving the rolls 14 within the facility. A work tracking system would typically be a server, such as a Web server, which provides an interface individuals and organizations can use, typically through the communication network. In addition to its work tracking functions, the work tracker may allow broader data logging and analysis functions. For example, operational data may be calculated from the data collected by the sensors on the device, assembly, or system of the present disclosure, and the system may be able to provide aggregate machine operational data for a device, assembly, or system of the present disclosure or group of devices, assemblies, or systems of the present disclosure.

The system also allows individuals to access the device, assembly, or system of the present disclosure for configuration and diagnostic purposes. In that case, the individual processors or microcontrollers of the device, assembly, or system of the present disclosure may be configured to act as Web servers that use a protocol like hypertext transfer protocol (HTTP) to provide an online interface that can be used to configure the device, assembly, or system. In some embodiments, the systems may be used to configure several devices, assemblies, or systems of the present disclosure at once. For example, if several devices, assemblies, or systems are of the same model and are in similar locations in the same location, it may not be necessary to configure the devices, assemblies, or systems individually. Instead, an individual may provide configuration information, including baseline operational parameters, for several devices, assemblies, or systems at once.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A mill roll storage assembly comprising:

a mill roll stand adapted to support one or more mill rolls in a vertical position;

a target shape coupled to or defined by a portion of the mill roll stand, wherein the target shape is in operative communication with a sensor on a crane located above the mill roll storage assembly, wherein the sensor is adapted to locate a center of the target shape;

an opening defined by the mill roll stand, wherein the opening is adapted to receive one mill roll in the vertical position;

a diagonal axis extending diagonally across the opening; and wherein the diagonal axis extends through a center of the shape on the target shape.

2. The mill roll storage assembly of claim 1, further comprising:

a target plate, wherein the target plate defines the target shape; and an interior edge on the target plate, wherein the interior edge defines the target shape and is formed as aperture in the target plate, the interior edge having an outline of the target shape, wherein the sensor is programmed to detect the target shape.

3. The mill roll storage assembly of claim 1, further comprising:

a target plate, wherein the target plate defines the target shape and the target plate is permanently affixed to a surface of the mill roll stand.

4. The mill roll storage assembly of claim 3, further comprising:

an edge on the target plate defining a truncated corner of the target plate, wherein the edge is aligned parallel to a longitudinal direction of the mill roll stand.

5. The mill roll storage assembly of claim 1, further comprising:

a target position fixture removably coupled to the mill roll stand.

6. The mill roll storage assembly of claim 5, further comprising:

a first direction associated with the target position fixture and a second direction associated with the target position fixture, wherein the first direction is perpendicular to the second direction;

a diagonal axis extending diagonally across the target position fixture relative to the first direction and the second direction; and a space defined by the target position fixture, and the target shape is centered in the space.

7. The mill roll storage assembly of claim 5, wherein the target position fixture further comprises:

a rectangular frame defining an opening, wherein the opening receives a portion of one mill roll therethrough;

a first corner of the rectangular frame, wherein a diagonal axis extends through the first corner from a center of the opening; and a first arm extending outwardly from adjacent the first corner of the rectangular frame, wherein the first arm is parallel to the diagonal axis.

8. The mill roll storage assembly of claim 5, wherein the target position fixture further comprises:

a frame defining an opening, wherein the opening receives a portion of the roll therethrough; and a first arm extending outwardly in a cantilevered manner from the frame, wherein the first arm is connected with a plate that defines the target.

9. A system for storing and lifting vertically oriented mill rolls, the system comprising:

a crane including at least one rail;

a trolley on the crane that moves relative to the at least one rail via at least one wheel;

a sensor that moves in unison with the trolley;

a mill roll stand that is positioned below the trolley;

at least one opening defined by the mill roll stand, wherein the at least one opening is adapted to receive a mill roll in a vertical position;

a target shape coupled to the mill roll stand, wherein the target shape is in operative communication with the sensor, wherein the sensor is adapted to locate a center of the target shape;

wherein a center of the target shape is arranged along an axis extending through a center of the at least one opening; and a controller having wheel float logic that is in operative communication with the sensor, wherein the controller is configured to determine an offset distance between a portion of the sensor with the center of the target shape and generate a signal that instructs the at least one wheel to move to thereby align the portion of the sensor with the center of the target shape.

10. The system of claim 9, further comprising:

a grasping and lifting device on the crane;

a trunnion defining an elevated end of one mill roll;

wherein alignment of the portion of the sensor with the center of the target shape results in the alignment of the grasping and lifting device with the elevated end of one mill roll.

11. The system of claim 9, wherein the sensor is an optical sensor having a field of view (FOV) that is directed downward from the trolley toward the mill roll stand.

12. The system of claim 11, further comprising:

a center of the FOV for the optical sensor;

wherein the portion of the sensor that is determined to be offset from the center of the target is the center of the FOV.

13. The system of claim 12, wherein the controller is configured to generate the signal to instruct the at least one wheel to move to thereby align the center of the FOV with the center of the target.

14. A method comprising:

providing a rack or stand containing at least one mill roll stored in a vertical position in an opening defined by the rack or stand;

positioning a target shape external the opening defined by the rack or stand;

moving a crane carrying a sensor above the at least one mill roll;

determining a center of the at least one mill roll via the sensor sensing a position of the crane relative to the target shape; and lifting the at least one mill roll by grasping an elevated end of the at least one mill roll from via the crane.

15. The method of claim 14, wherein the sensor is an optical sensor, further comprising:

viewing, with the optical sensor, the target shape; and determining a center of the target shape.

16. The method of claim 15, further comprising determining an offset of a center of a field of view (FOV) of the optical sensor from the center of the target shape.

17. The method of claim 16, further comprising:

moving the crane a distance equal to the offset to align a grasping and lifting device of the crane with a center of the elevated end of the at least one mill roll.

18. The method of claim 17, further comprising:

sending a signal to a motor on the crane to move the crane in at least one of two directions to align the grasping and lifting device with the center of the elevated end of the at least one mill roll; and lowering the grasping device in a third direction toward the elevated end of the vertical roll.

* * * * *